US008363864B2

(12) United States Patent
Chung et al.

(10) Patent No.: US 8,363,864 B2
(45) Date of Patent: Jan. 29, 2013

(54) PIEZOELECTRIC MICRO-ACOUSTIC TRANSDUCER AND METHOD OF FABRICATING THE SAME

(75) Inventors: Seok-Whan Chung, Suwon-si (KR); Dong-Kyun Kim, Suwon-si (KR); Byung-Gil Jeong, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 22 days.

(21) Appl. No.: 13/080,927

(22) Filed: Apr. 6, 2011

(65) Prior Publication Data

US 2011/0182450 A1 Jul. 28, 2011

Related U.S. Application Data

(63) Continuation-in-part of application No. 12/430,652, filed on Apr. 27, 2009.

(30) Foreign Application Priority Data

Sep. 25, 2008 (KR) ..... 10-2008-0094096

(51) Int. Cl.
*H01R 25/00* (2006.01)

(52) U.S. Cl. ..... 381/190; 29/25.35; 310/367

(58) Field of Classification Search ..... 381/190; 29/25.35; 310/367
See application file for complete search history.

(56) References Cited

U.S. PATENT DOCUMENTS

| | | | | |
|---|---|---|---|---|
| 4,816,125 | A | 3/1989 | Muller et al. | |
| 5,209,118 | A | 5/1993 | Jerman | |
| 5,633,552 | A | 5/1997 | Lee et al. | |
| 6,857,501 | B1 | 2/2005 | Han et al. | |
| 6,967,362 | B2 | 11/2005 | Nam et al. | |
| 7,089,638 | B2 | 8/2006 | Yi et al. | |
| 2009/0154734 | A1 | 6/2009 | Jeong et al. | |
| 2010/0040246 | A1* | 2/2010 | Windischberger et al. | 381/150 |
| 2010/0072860 | A1 | 3/2010 | Kim et al. | |
| 2010/0074459 | A1 | 3/2010 | Chung et al. | |
| 2010/0156238 | A1 | 6/2010 | Kim et al. | |
| 2011/0038495 | A1 | 2/2011 | Jeong et al. | |
| 2011/0051985 | A1 | 3/2011 | Hwang et al. | |
| 2011/0064250 | A1 | 3/2011 | Jeong et al. | |
| 2011/0075867 | A1 | 3/2011 | Chung et al. | |
| 2011/0075879 | A1 | 3/2011 | Kim et al. | |
| 2011/0085684 | A1 | 4/2011 | Kim et al. | |
| 2011/0147864 | A1* | 6/2011 | Kramer et al. | 257/419 |

FOREIGN PATENT DOCUMENTS

| | | | |
|---|---|---|---|
| JP | 2001025095 | A | 1/2001 |
| KR | 20030062897 | A | 7/2003 |
| KR | 20030062899 | A | 7/2003 |
| KR | 20030090189 | A | 11/2003 |
| KR | 20040026756 | A | 4/2004 |
| KR | 100466808 | B1 | 1/2005 |
| KR | 20050076150 | A | 7/2005 |
| KR | 100512960 | B1 | 9/2005 |
| KR | 20060093464 | A | 8/2006 |
| KR | 20060127013 | A | 12/2006 |

(Continued)

*Primary Examiner* — Alexander Ghyka
*Assistant Examiner* — Stanetta Isaac
(74) *Attorney, Agent, or Firm* — Sughrue Mion, PLLC

(57) ABSTRACT

Provided are a piezoelectric micro-acoustic transducer and a method of fabricating the same. In the piezoelectric micro-acoustic transducer, a diaphragm is divided into a first region and a second region. The first region may be formed of a material capable of maximizing the exciting force, and the second region may be formed of a material having less initial stress and a lower Young's modulus than the first region. Also, the second region has a corrugated shape.

6 Claims, 57 Drawing Sheets

FOREIGN PATENT DOCUMENTS

| | | | |
|---|---|---|---|
| KR | 100756532 | B1 | 9/2007 |
| KR | 20090063950 | A | 6/2009 |
| KR | 20100033807 | A | 3/2010 |
| KR | 20100034883 | A | 4/2010 |
| KR | 20100071607 | A | 6/2010 |
| KR | 20110016667 | A | 2/2011 |
| KR | 10-2011-0029812 | A | 3/2011 |
| KR | 10-2011-0033593 | A | 3/2011 |
| KR | 20110023535 | A | 3/2011 |
| KR | 10-2011-0034960 | A | 4/2011 |
| KR | 10-2011-0039815 | A | 4/2011 |
| WO | 2005/053357 | A1 | 6/2005 |

* cited by examiner

PIEZOELECTRIC MICRO-ACOUSTIC TRANSDUCER AND METHOD OF FABRICATING THE SAME

CROSS-REFERENCE TO RELATED APPLICATIONS

This application is a Continuation-in-part of prior U.S. application Ser. No. 12/430,652, filed on Apr. 27, 2009, which claims priority from Korean Patent Application No. 10-2008-0094096, filed on Sep. 25, 2008, the disclosures of which are incorporated herein in their entirety by reference.

BACKGROUND

1. Field

One or more embodiments relate to a microspeaker, and more particularly, to a micro-electro-mechanical systems (MEMS)-based piezoelectric microspeaker and a method of fabricating the same.

2. Description of the Related Art

The piezoelectric effect is the reversible conversion of mechanical energy into electrical energy using a piezoelectric material. In other words, the piezoelectric effect is a phenomenon in which a potential difference is generated when pressure or vibration is applied to a piezoelectric material, and the piezoelectric material deforms or vibrates when a potential difference is applied.

Piezoelectric speakers use the principle of applying a potential difference to a piezoelectric material to deform or vibrate the piezoelectric material and generating sound according to the vibration.

With the rapid progress of personal mobile communication, research on a subminiature acoustic transducer has been carried out for several decades. In particular, piezoelectric microspeakers have been researched due to their simple structures and ability to operate at low voltage.

In general, a piezoelectric microspeaker includes a piezoelectric plate on both sides of which electrode layers are formed, and a diaphragm which is not piezoelectric. When voltage is applied through the electrode layers, the piezoelectric plate is deformed, which causes the diaphragm to vibrate and generate sound.

However, since the piezoelectric microspeaker has a lower sound output level than a voice coil microspeaker, there are few cases of it being put to practical use. Thus, a piezoelectric microspeaker which has a small size and a high sound output level is needed.

SUMMARY

A piezoelectric micro-acoustic transducer according to an embodiment includes a substrate and a diaphragm. A hole is formed through the substrate in its thickness direction. The diaphragm is formed on the substrate and covers the hole, and includes a first vibration layer formed in a first region corresponding to a center of the hole and a second vibration layer formed at least in a second region corresponding to an edge of the hole, formed of a material having a lower Young's modulus than that of the first vibration layer, and having a corrugated shape.

The piezoelectric micro-acoustic transducer further includes a piezoelectric driver for driving the diaphragm, and a feeder cable unit for supplying a voltage or current to the piezoelectric driver. The feeder cable unit connects the piezoelectric driver to an external power supply through the second region. The feeder cable unit also has a corrugated shape corresponding to the corrugated shape of the second vibration layer.

A method of fabricating a piezoelectric micro-acoustic transducer according to another embodiment includes: forming a first vibration layer on an upper side of a substrate; etching a part of the first vibration layer to form a corrugated region including at least one trench; forming a second vibration layer having a Young's modulus lower than that of the first vibration layer in the at least one trench; and forming a hole in the substrate by etching the a lower side of the substrate until the first vibration layer and the second vibration layer are exposed.

The method further includes, before forming the second vibration layer, forming: a first electrode layer on the first vibration layer, forming a first feeder cable unit electrically connected to the first electrode unit, forming a piezoelectric layer on the first electrode layer, forming a second electrode layer on the piezoelectric layer, and forming a second feeder cable unit electrically connected to the second electrode layer, wherein the first feeder cable unit and the second feeder cable unit each have a corrugated shape corresponding to the at least one trench.

It is to be understood that both the foregoing general description and the following detailed description are exemplary and explanatory and are intended to provide further explanation of the inventive concept.

BRIEF DESCRIPTION OF THE DRAWINGS

The above and/or other aspects will become apparent and more readily appreciated from the following description of embodiments taken in conjunction with the accompanying drawings in which.

DETAILED DESCRIPTION

Figure 1:
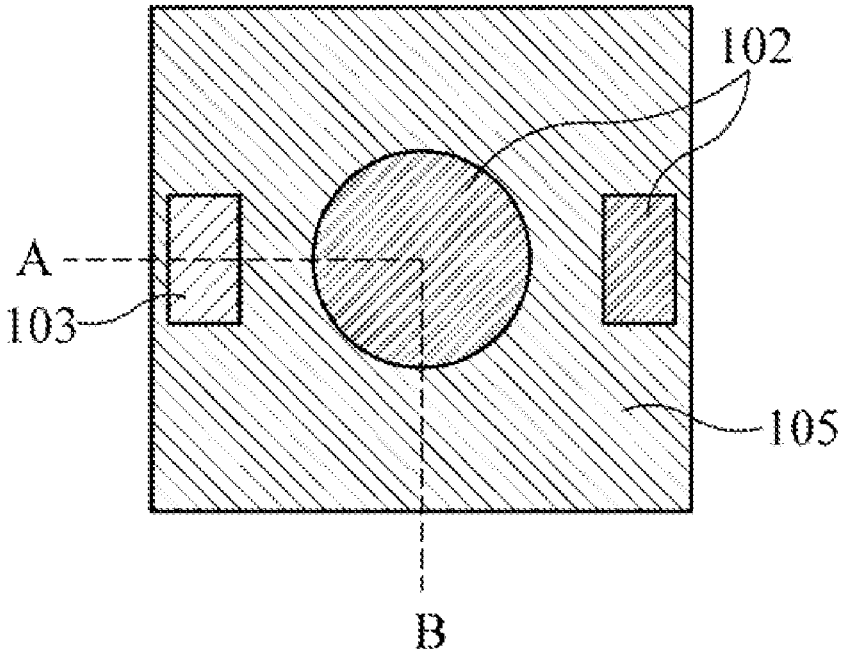
FIG. 1 is a plan view of a piezoelectric microspeaker according to an exemplary embodiment.

Embodiments will be described more fully hereinafter with reference to the accompanying drawings. This general inventive concept may, however, be embodied in many different forms and should not be construed as limited to the embodiments set forth herein. Rather, these embodiments are provided so that this disclosure is thorough, and will fully convey the scope of the general inventive concept to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Figure 2:
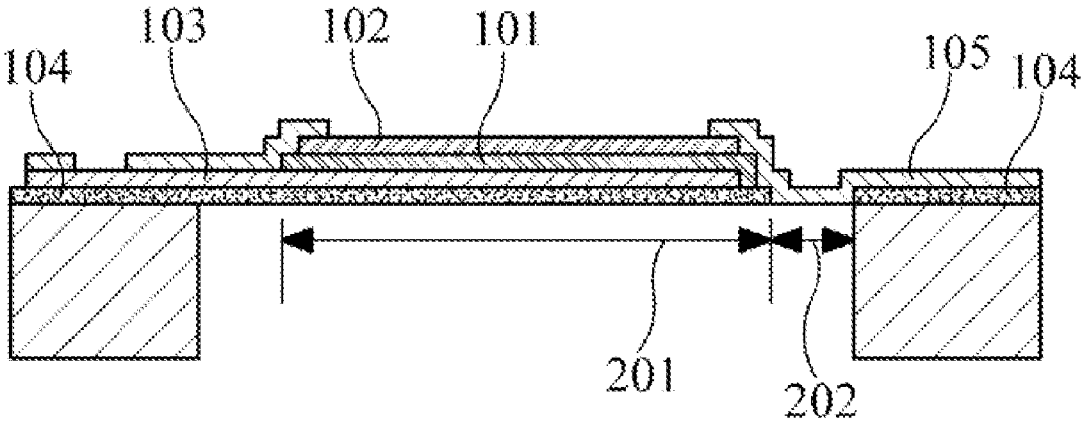
FIG. 2 is a cross-sectional view of the piezoelectric microspeaker of the embodiment of FIG. 1.

FIG. 1 is a plan view of a piezoelectric microspeaker according to an embodiment, and FIG. 2 is a cross-sectional view taken along line A-B of FIG. 1.

Referring to FIGS. 1 and 2, the piezoelectric microspeaker according to this embodiment may include a piezoelectric plate 101 which deforms according to a voltage applied thereto, upper and lower electrodes 102 and 103, and a diaphragm 104 which vibrates due to deformation of the piezoelectric plate 101.

When voltage is applied to the piezoelectric plate 101 through the upper and lower electrodes 102 and 103, the piezoelectric plate 101 deforms according to the voltage. Deformation of the piezoelectric plate 101 causes the diaphragm 104 to vibrate and generate sound.

The diaphragm 104 may include a first region 201 and a second region 202. For example, the first region 201 may be directly under the piezoelectric plate 101, and the second region 202 may be the whole or a part of the diaphragm 104 excluding the first region 201.

The first region 201 and the second region 202 may be formed of materials having different Young's moduli. For example, the first region 201 may be formed of a material having a Young's modulus similar to that of the piezoelectric plate 101, and the second region 202 may be formed of a material having a Young's modulus lower than that of the first region 201.

For example, the piezoelectric plate 101 may be formed of a thin aluminum nitride (AlN) layer or a thin zinc oxide (ZnO) layer having a Young's modulus of about 50 Gpa to 500 Gpa. The first region 201 of the diaphragm 104 may be formed of silicon nitride (SiN) having a Young's modulus similar to that of the piezoelectric plate 101, and the second region 202 of the diaphragm 104 may be formed of a thin polymer layer 105 having a Young's modulus of about 100 Mpa to 5 Gpa.

In the piezoelectric microspeaker according to this embodiment, the center of the diaphragm 104 is formed of a material having a similar Young's modulus to the piezoelectric plate 101, and the edge of the diaphragm 104 is formed of a soft material having a lower Young's modulus than the center. Thus, the piezoelectric microspeaker according to this embodiment may be called a microspeaker having a soft edge.

Since the region of the diaphragm 104 directly under the piezoelectric plate 101 is formed of the material having a Young's modulus similar to that of the piezoelectric plate 101 and the other region of the diaphragm 104 is formed of the material having a Young's modulus lower than that of the region, deformation efficiency of the diaphragm 104 can be improved, and an output sound pressure level in a low-frequency band can be increased by reducing structural stiffness.

FIGS. 3(A) to 3(G) are cross-sectional views illustrating a method of fabricating a piezoelectric microspeaker according to an embodiment. These may be an example of a method of fabricating the piezoelectric microspeaker of FIG. 2.

The method of fabricating the piezoelectric microspeaker according to this embodiment of the present invention will be described below with reference to FIGS. 2 and 3A to 3G.

Figure 3A:
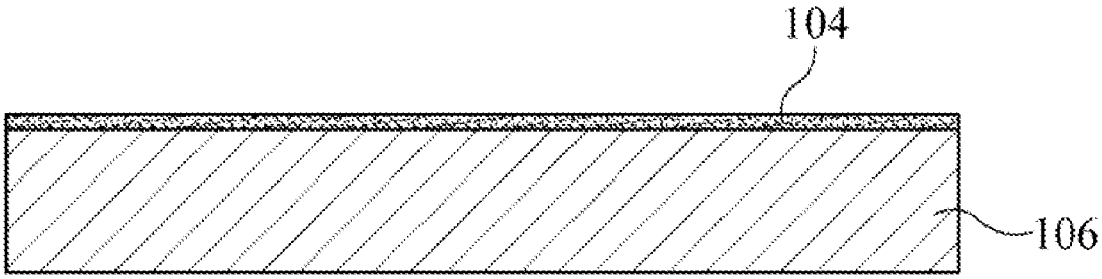
FIGS. 3(A) to 3(G) are cross-sectional views illustrating a method of fabricating the piezoelectric microspeaker of the embodiment of FIG. 1.

First, as illustrated in FIG. 3(A), the diaphragm 104 is formed on a silicon substrate 106. For example, the diaphragm 104 may be formed by depositing low-stress silicon nitride to a thickness of about 0.5 μm to 3 μm using a chemical vapor deposition (CVD) process.

Figure 3B:
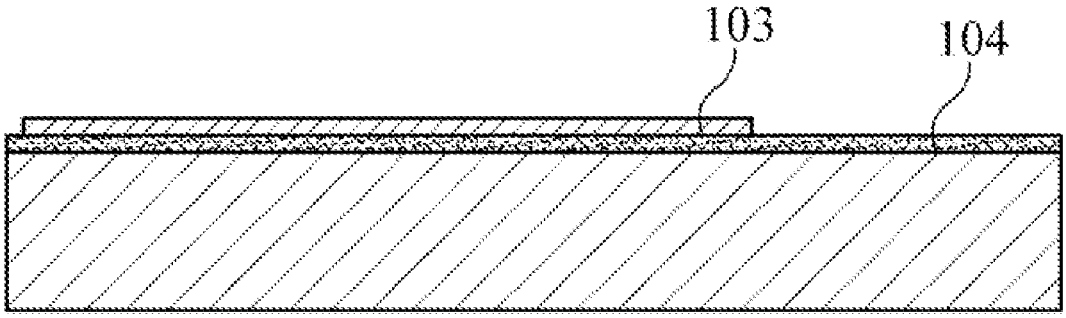

Subsequently, as illustrated in FIG. 3(B), the lower electrode 103 is formed on the diaphragm 104. For example, the lower electrode 103 may be formed by depositing a metal, such as Au, Mo, Cu or Al, to a thickness of about 0.1 μm to 3 μm using sputtering or evaporation, and patterning the deposited layer.

Figure 3C:
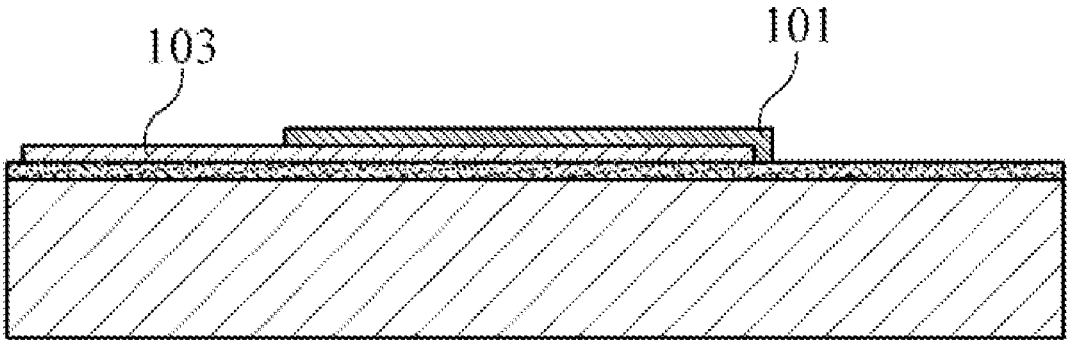

Subsequently, as illustrated in FIG. 3(C), the piezoelectric plate 101 is formed on the lower electrode 103. For example, the piezoelectric plate 101 may be formed by depositing a piezoelectric material, such as AlN or ZnO, to a thickness of about 0.1 μm to 3 μm using a sputtering process and patterning the deposited layer.

Figure 3D:
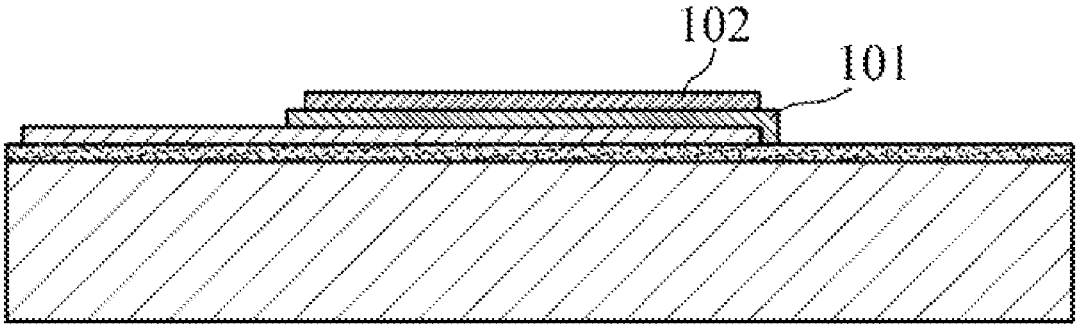

Subsequently, as illustrated in FIG. 3(D), the upper electrode 102 is formed on the piezoelectric plate 101. For example, the upper electrode 102 may be formed by depositing a metal, such as Au, Mo, Cu or Al, to a thickness of about 0.1 μm to 3 μm using sputtering or evaporation, and patterning the deposited layer.

Figure 3E:
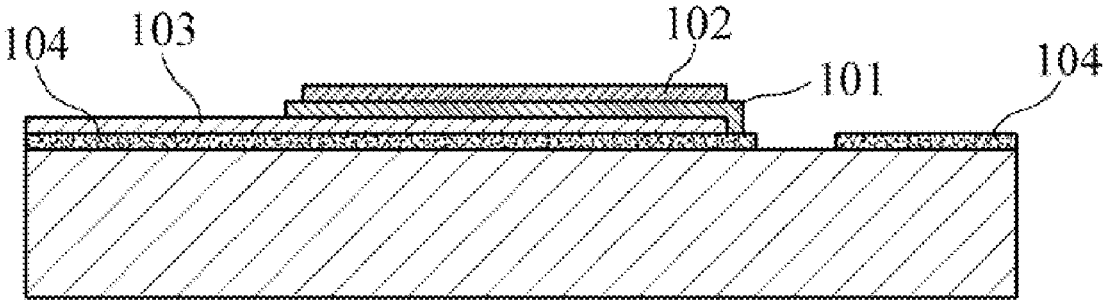

Subsequently, as illustrated in FIG. 3(E), a part of the diaphragm 104 is removed. For example, the piezoelectric plate 101 and the upper and lower electrodes 102 and 103 are covered with an etch mask, a non-covered part of the diaphragm 104 is selectively etched, and thus the part of the diaphragm 104 can be removed. Here, the removed part of the diaphragm 104 may be the whole or a part of the diaphragm 104 excluding a region directly under the piezoelectric plate 101, and provides a space in which the above-mentioned second region 202 will be formed.

Figure 3F:
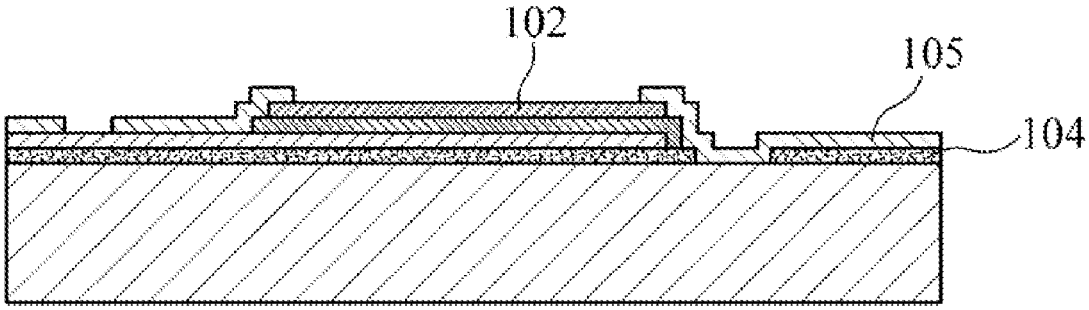

Subsequently, as illustrated in FIG. 3(F), the thin polymer layer 105 is deposited on the entire substrate 106 including a region from which the part of the diaphragm 104 is removed, and is selectively removed. For example, parylene is deposited to a thickness of about 0.5 μm to 10 μm, and then the deposited parylene can be selectively removed by $O_2$ plasma etching using photoresist as an etch mask. Here, parylene deposited on the upper electrode 102 is removed to expose the upper electrode 102 to the outside.

Figure 3G:
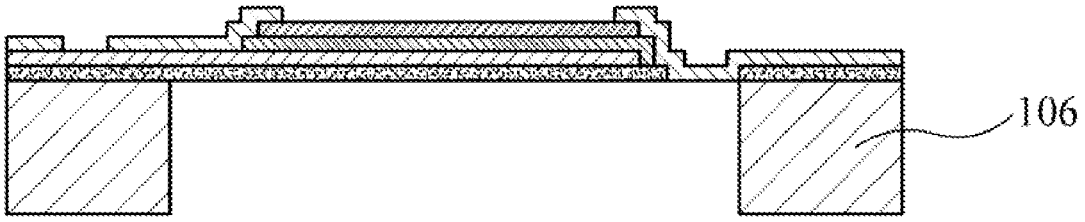

Finally, as illustrated in FIG. 3(G), a part of the substrate 106 is etched from the lower side to release the diaphragm 104.

Figure 4:
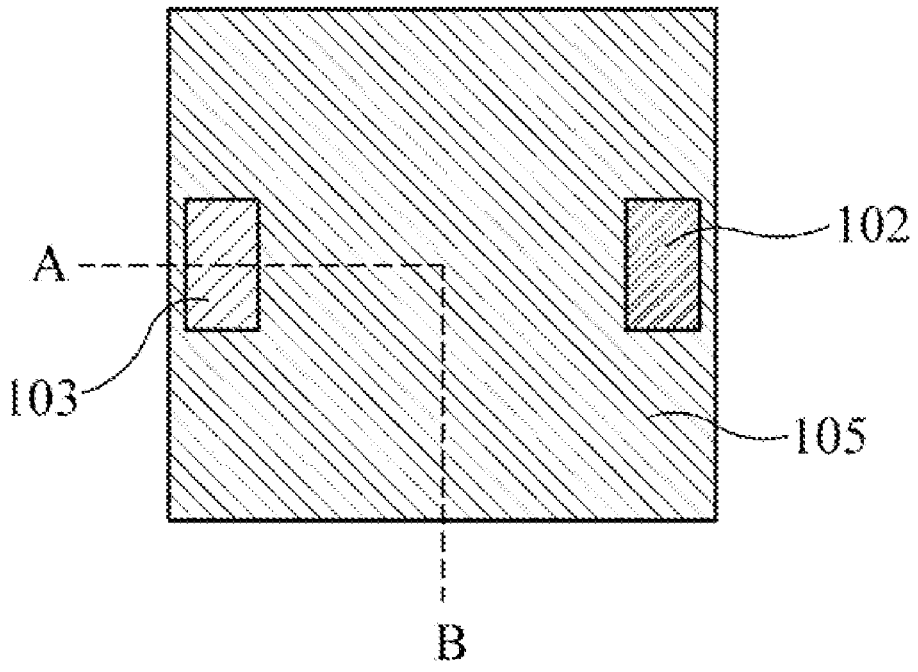
FIG. 4 is a plan view of a piezoelectric microspeaker according to a another exemplary embodiment.
Figure 5:
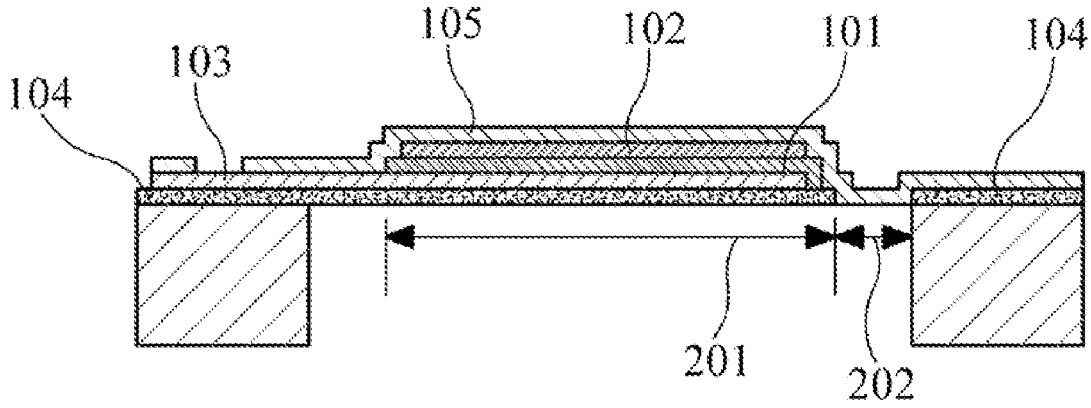
FIG. 5 is a cross-sectional view of the piezoelectric microspeaker according to the exemplary embodiment of FIG. 4.

FIG. 4 is a plan view of a piezoelectric microspeaker according to another embodiment, and FIG. 5 is a cross-sectional view taken along line A-B of FIG. 4.

Referring to FIGS. 4 and 5, the piezoelectric microspeaker according to this embodiment includes a piezoelectric plate 101, upper and lower electrodes 102 and 103, and a diaphragm 104. The diaphragm 104 includes a first region 201 and a second region 202 having different Young's moduli. The first region 201 may be formed of a material having a Young's modulus similar to that of the piezoelectric plate 101, and the second region 202 may be formed of a material having a Young's modulus lower than that of the first region 201. This is the same as described with reference to FIGS. 1 and 2.

However, while the thin polymer layer 105 deposited on the upper electrode 102 is selectively removed to externally expose the upper electrode 102 to the outside of the structure of FIG. 2, the upper electrode 102 is not externally exposed to the outside of the structure of FIG. 5.

FIGS. 6(A) to 6(G) are cross-sectional views illustrating a method of fabricating a piezoelectric microspeaker according to another embodiment. This may be an example of a method of fabricating the piezoelectric microspeaker of FIG. 5.

The method of fabricating the piezoelectric microspeaker according to this embodiment will be described below with reference to FIGS. 6(A) to 6(G).

Figure 6A:
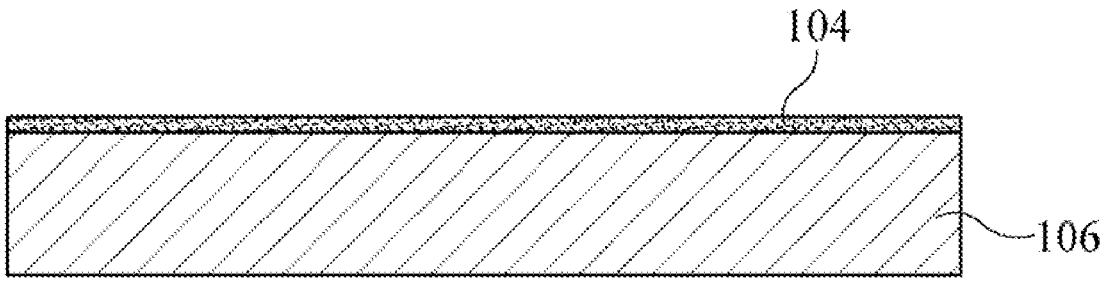
FIGS. 6(A) to 6(G) are cross-sectional views illustrating a method of fabricating the piezoelectric microspeaker according to the exemplary embodiment of FIG. 4.

First, as illustrated in FIG. 6(A), the diaphragm 104 is formed on a silicon substrate 106. For example, the diaphragm 104 may be formed by depositing low-stress silicon nitride to a thickness of about 0.5 μm to 3 μm using a CVD process.

Figure 6B:
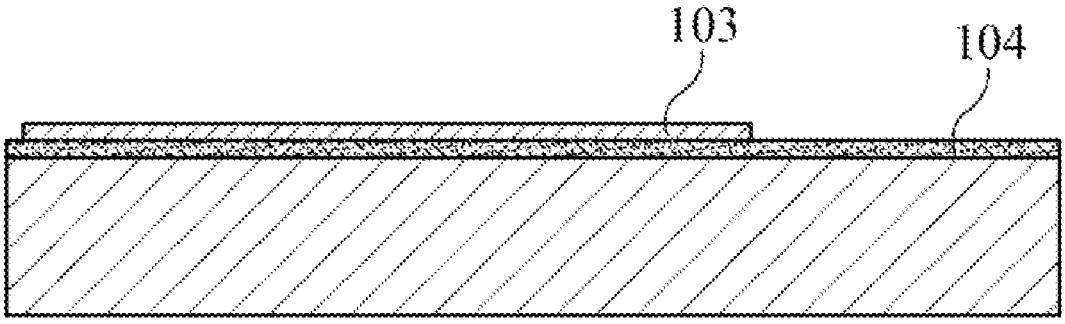

Subsequently, as illustrated in FIG. 6(B), the lower electrode 103 is formed on the diaphragm 104. For example, the lower electrode 103 may be formed by depositing a metal, such as Au, Mo, Cu or Al, to a thickness of about 0.1 μm to 3 μm using sputtering or evaporation, and patterning the deposited layer.

Figure 6C:
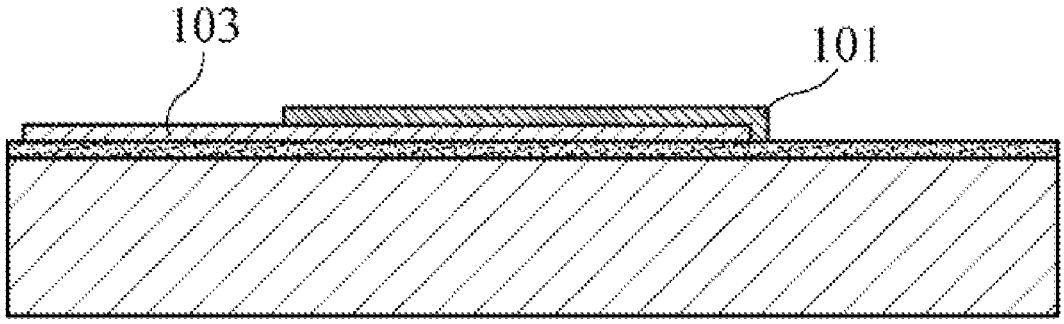

Subsequently, as illustrated in FIG. 6(C), the piezoelectric plate 101 is formed on the lower electrode 103. For example, the piezoelectric plate 101 may be formed by depositing a piezoelectric material, such as AlN or ZnO, to a thickness of about 0.1 μm to 3 μm using a sputtering process and patterning the deposited layer.

Figure 6D:
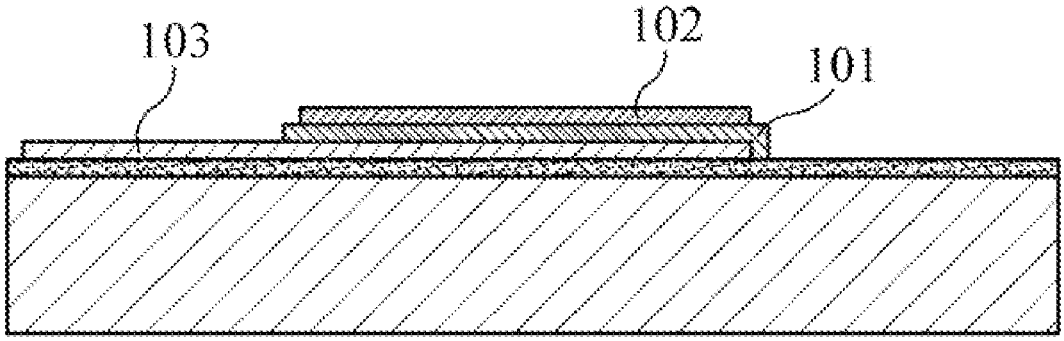

Subsequently, as illustrated in FIG. 6(D), the upper electrode 102 is formed on the piezoelectric plate 101. For example, the upper electrode 102 may be formed by depositing a metal, such as Au, Mo, Cu or Al, to a thickness of about 0.1 μm to 3 μm using sputtering or evaporation, and patterning the deposited layer.

Figure 6E:
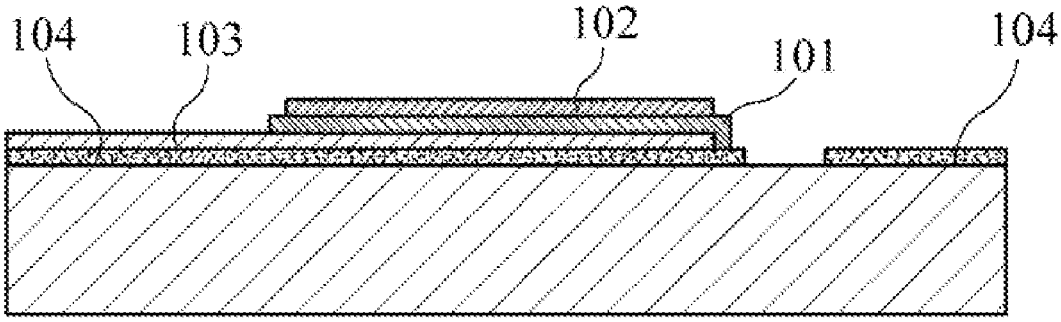

Subsequently, as illustrated in FIG. 6(E), a part of the diaphragm 104 is removed. For example, the piezoelectric plate 101 and the upper and lower electrodes 102 and 103 are covered with an etch mask, a non-covered part of the diaphragm 104 is selectively etched, and thus the part of the diaphragm 104 can be removed. Here, the removed part of the diaphragm 104 may be the whole or a part of the diaphragm 104 excluding a region directly under the piezoelectric plate 101, and provides a space in which the above-mentioned second region 202 will be formed.

Figure 6F:
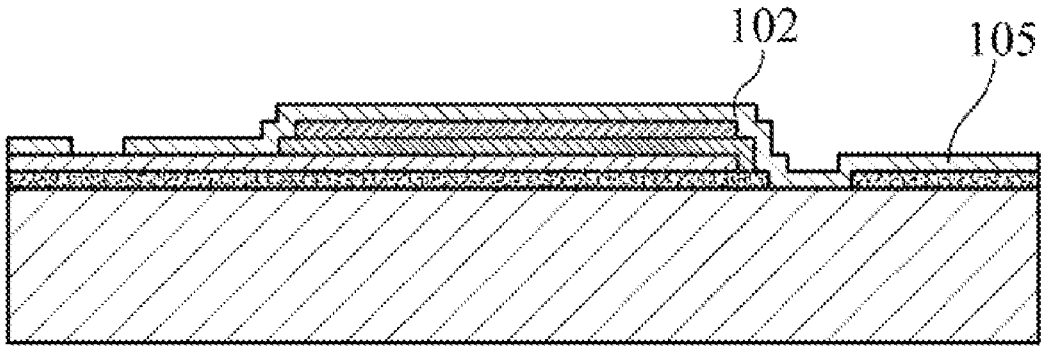

Subsequently, as illustrated in FIG. 6(F), a thin polymer layer 105 is deposited on the entire substrate 106 including a region from which the part of the diaphragm 104 is removed, and is selectively removed. For example, parylene is deposited to a thickness of about 0.5 μm to 10 μm, and then the deposited parylene can be selectively removed by $O_2$ plasma etching using photoresist as an etch mask. Here, parylene deposited on the upper electrode 102 is not etched so as not to expose the upper electrode 102 to the outside.

Figure 6G:
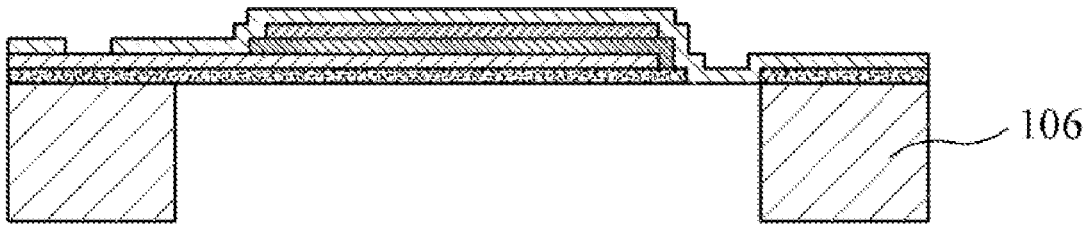

Finally, as illustrated in FIG. 6(G), a part of the substrate 106 is etched from the lower side to release the diaphragm 104.

Figure 7:
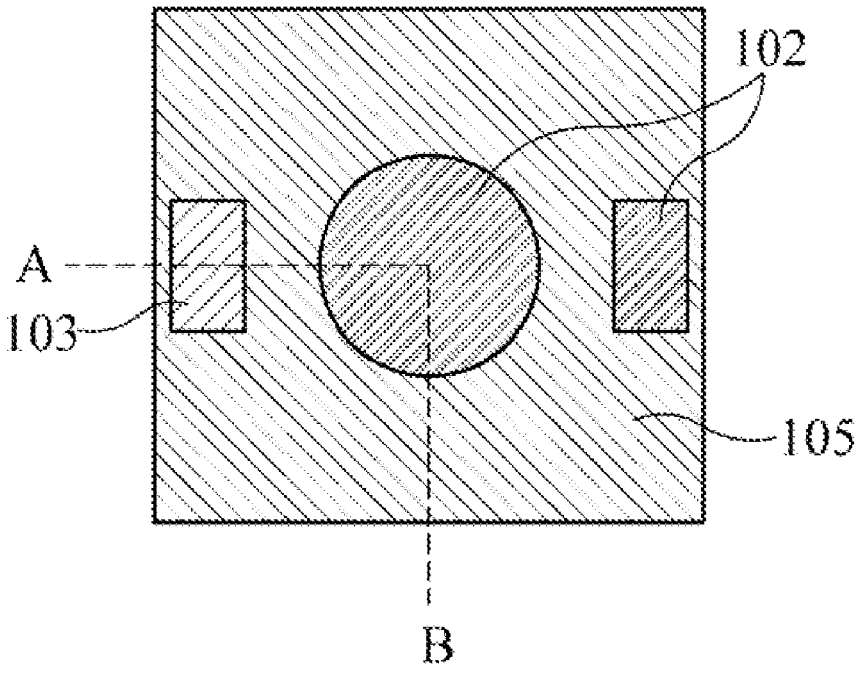
FIG. 7 is a plan view of a piezoelectric microspeaker according to another exemplary embodiment.
Figure 8:
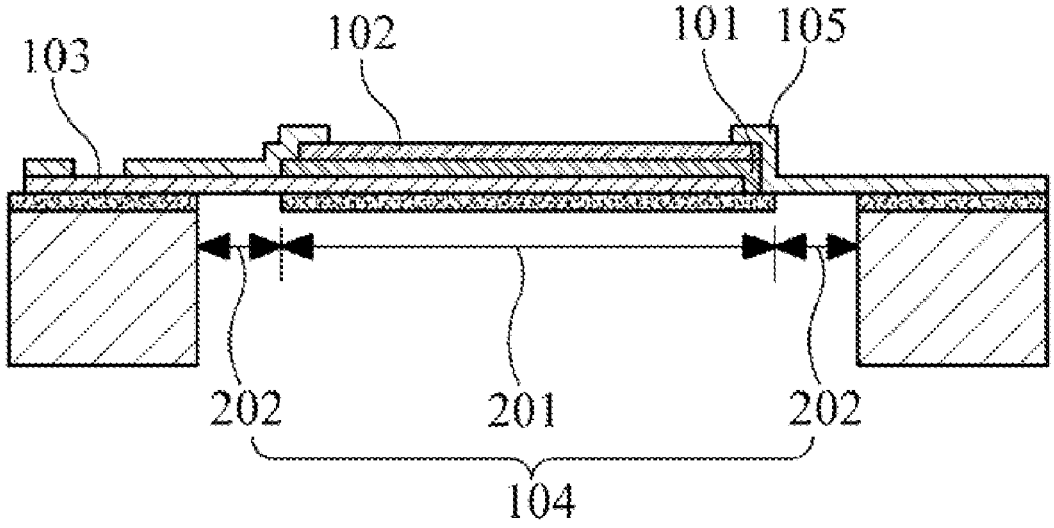
FIG. 8 is a cross-sectional view of the piezoelectric microspeaker according to the exemplary embodiment of FIG. 7.

FIG. 7 is a plan view of a piezoelectric microspeaker according to yet another embodiment, and FIG. 8 is a cross-sectional view taken along line A-B of FIG. 7.

Referring to FIGS. 7 and 8, the piezoelectric microspeaker according to this embodiment includes a piezoelectric plate 101, upper and lower electrodes 102 and 103, and a diaphragm 104. The diaphragm 104 includes a first region 201 and a second region 202 having different Young's moduli. The first region 201 may be formed of a material having a Young's modulus similar to that of the piezoelectric plate 101, and the second region 202 may be formed of a material having a Young's modulus lower than that of the first region 201. For example, the second region 202 may be understood as a region from which a part of the diaphragm 104 is removed and filled with a thin polymer layer 105.

FIGS. 9(A) to 9(F) are cross-sectional views illustrating a method of fabricating the piezoelectric microspeaker according to yet another embodiment. This may be an example of a method of fabricating the piezoelectric microspeaker of FIG. 8.

The method of fabricating the piezoelectric microspeaker according to this embodiment will be described below with reference to FIGS. 9(A) to 9(F).

Figure 9A:
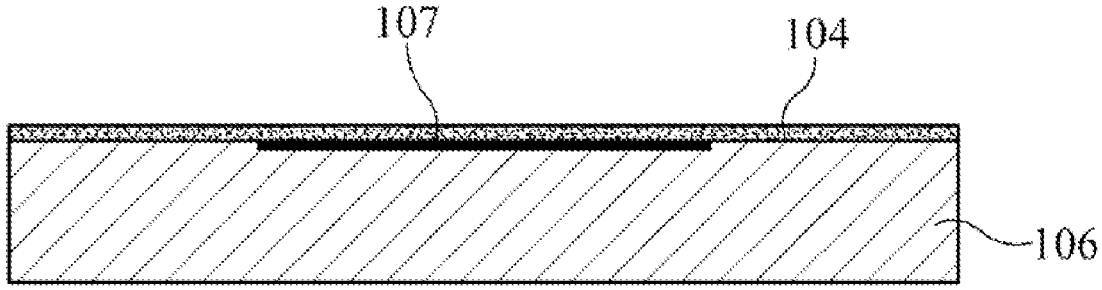
FIGS. 9(A) to 9(F) are cross-sectional views illustrating a method of fabricating the piezoelectric microspeaker according to the exemplary embodiment of FIG. 7.

First, as illustrated in FIG. 9(A), an etch stop layer 107 is formed on a substrate 106, and the diaphragm 104 is formed on the substrate 106. Here, the diaphragm 104 may be formed by depositing low-stress silicon nitride.

Figure 9B:
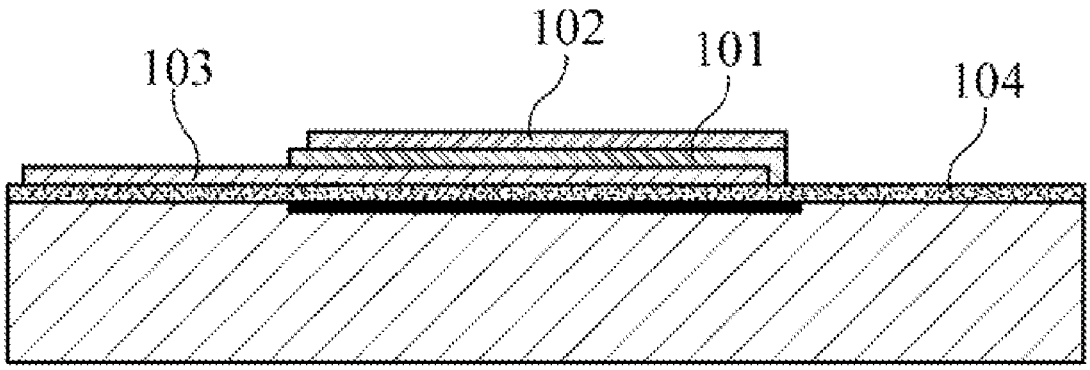

Subsequently, as illustrated in FIG. 9(B), the lower electrode 103 is formed by depositing and etching a thin metal layer on the diaphragm 104, the piezoelectric plate 101 is formed by depositing and etching a thin piezoelectric layer on the lower electrode 103, and then the upper electrode 102 is formed by again depositing and etching a thin metal layer on the piezoelectric plate 101.

Figure 9C:
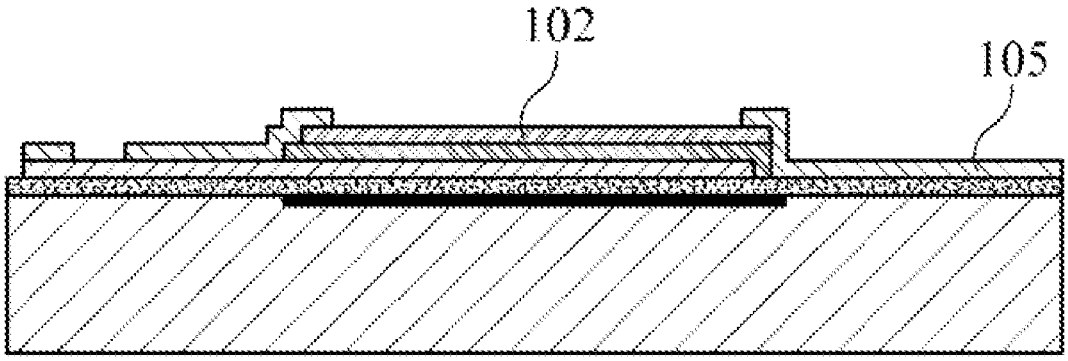

Subsequently, as illustrated in FIG. 9(C), the thin polymer layer 105 is deposited on the entire substrate 106 and selectively removed. At this time, the removed part may include a part on the upper electrode 102. The thin polymer layer 105 may be a thin parylene layer having a lower Young's modulus than the piezoelectric plate 101.

Figure 9D:
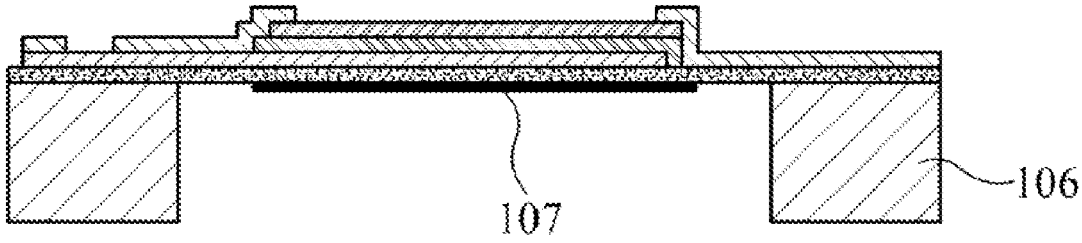

Subsequently, as illustrated in FIG. 9(D), a part of the substrate 106 is etched from the lower side to release the etch stop layer 107 and the diaphragm 104.

Figure 9E:
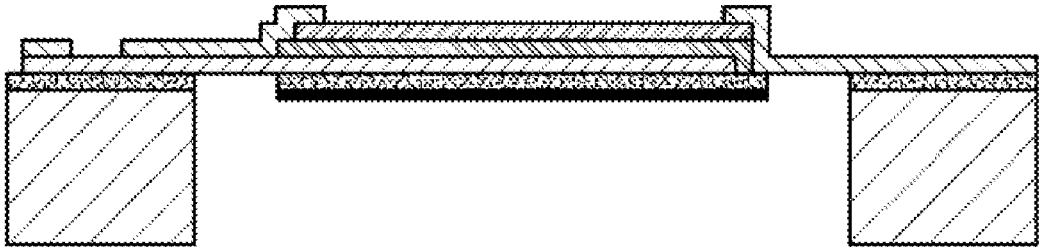

Subsequently, as illustrated in FIG. 9(E), a part of the diaphragm 104 is removed. For example, the diaphragm 104 excluding a part on which the etch stop layer 107 is formed can be removed by etching the diaphragm 104 from the lower side of the substrate 106.

Figure 9F:
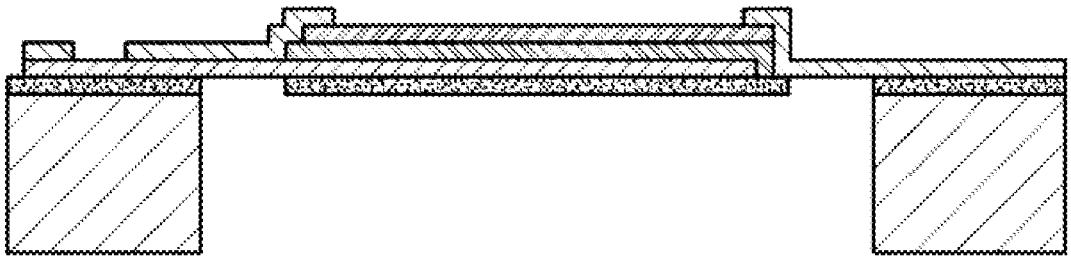

Finally, as illustrated in FIG. 9(F), the etch stop layer 107 is removed.

Figure 10:
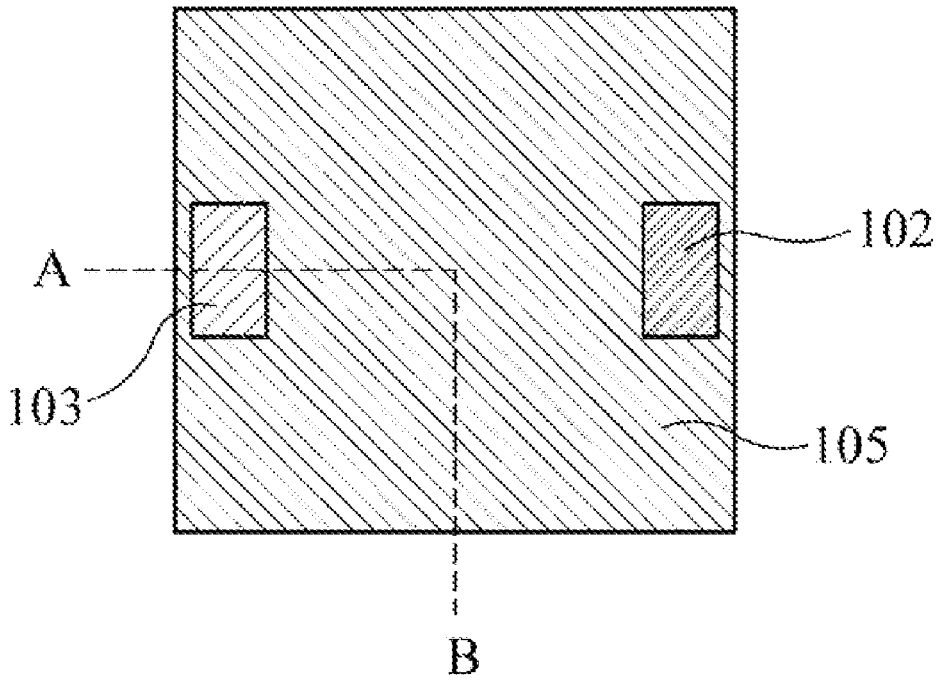
FIG. 10 is a plan view of a piezoelectric microspeaker according to another exemplary embodiment.
Figure 11:
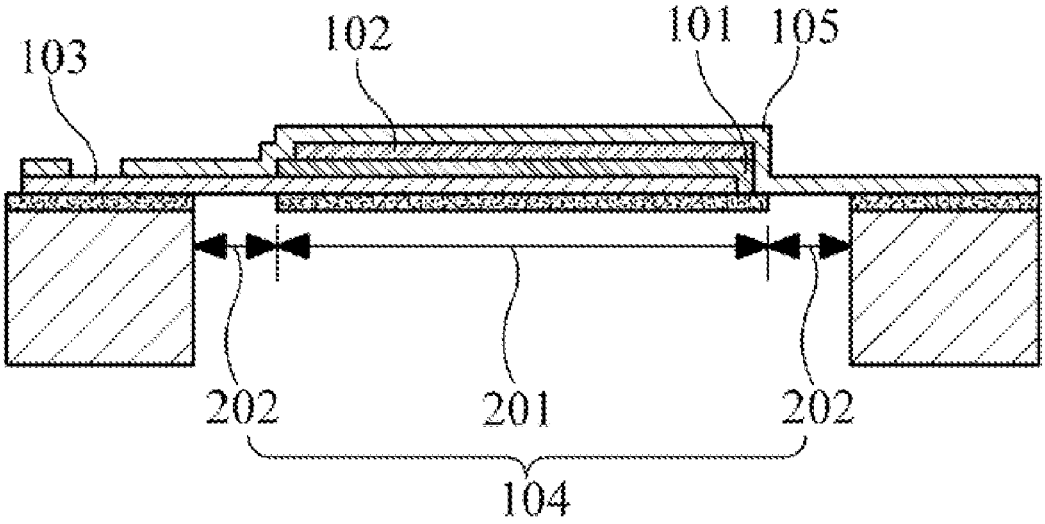
FIG. 11 is a cross-sectional view of the piezoelectric microspeaker according to the exemplary embodiment of FIG. 10.

FIG. 10 is a plan view of a piezoelectric microspeaker according to yet another embodiment, and FIG. 11 is a cross-sectional view taken along line A-B of FIG. 10.

Referring to FIGS. 10 and 11, the piezoelectric microspeaker according to this embodiment includes a piezoelectric plate 101, upper and lower electrodes 102 and 103, and a diaphragm 104. The diaphragm 104 includes a first region 201 and a second region 202 having different Young's moduli. The first region 201 may be formed of a material having a Young's modulus similar to that of the piezoelectric plate 101, and the second region 202 may be formed of a material having a Young's modulus lower than that of the first region 201. This is the same as described with reference to FIGS. 7 and 8.

However, while the thin polymer layer 105 deposited on the upper electrode 102 is selectively removed to expose the upper electrode 102 to the outside in the structure of FIG. 8, the upper electrode 102 is not exposed to the outside in the structure of FIG. 11.

FIGS. 12(A) to 12(F) are cross-sectional views illustrating a method of fabricating the piezoelectric microspeaker according to yet another embodiment.

The method of fabricating the piezoelectric microspeaker according to this embodiment will be described below with reference to FIGS. 12(A) to 12(F).

Figure 12A:
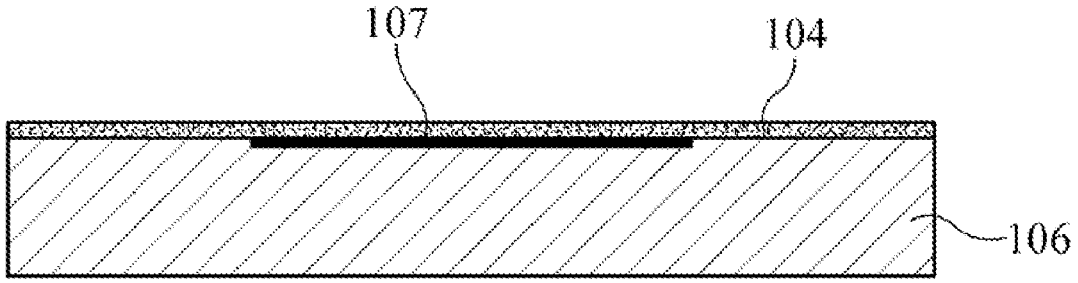
FIGS. 12(A) to 12(F) are cross-sectional views illustrating a method of fabricating the piezoelectric microspeaker according to the exemplary embodiment of FIG. 10.

First, as illustrated in FIG. 12(A), an etch stop layer 107 is formed on a substrate 106, and a diaphragm 104 is formed on the substrate 106. Here, the diaphragm 104 may be formed by depositing low-stress silicon nitride.

Figure 12B:
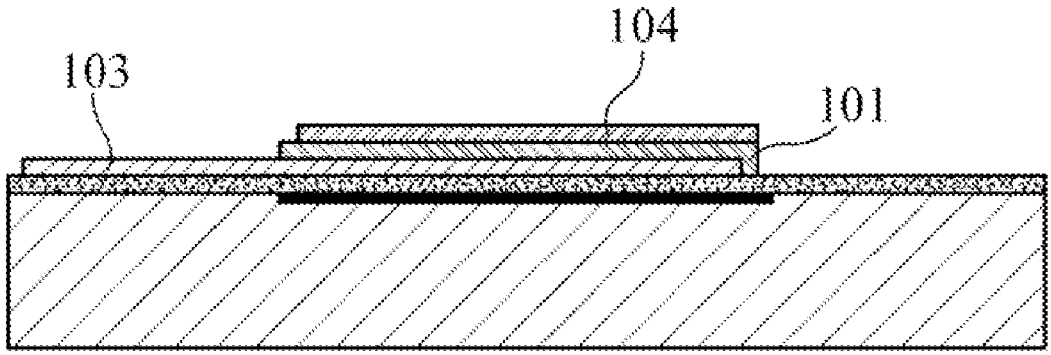

Subsequently, as illustrated in FIG. 12(B), the lower electrode 103 is formed by depositing and etching a thin metal layer on the diaphragm 104, the piezoelectric plate 101 is formed by depositing and etching a thin piezoelectric layer on the lower electrode 103, and then the upper electrode 102 is formed by again depositing and etching a thin metal layer on the piezoelectric plate 101.

Figure 12C:
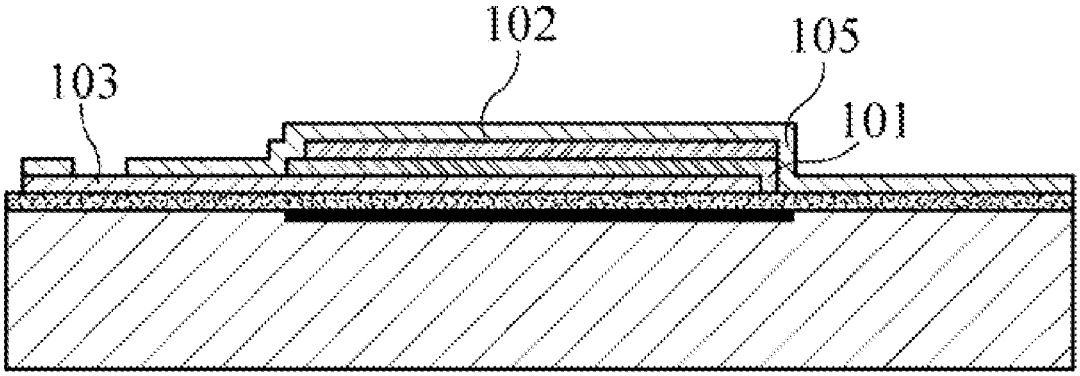

Subsequently, as illustrated in FIG. 12(C), a thin polymer layer 105 is deposited on the entire substrate 106 and selectively removed. At this time, the thin polymer layer 105 deposited on the upper electrode may not be removed, and thus it is possible not to expose the upper electrode 102 to the outside. The thin polymer layer 105 may be a thin parylene layer having a lower Young's modulus than the piezoelectric plate 101.

Figure 12D:
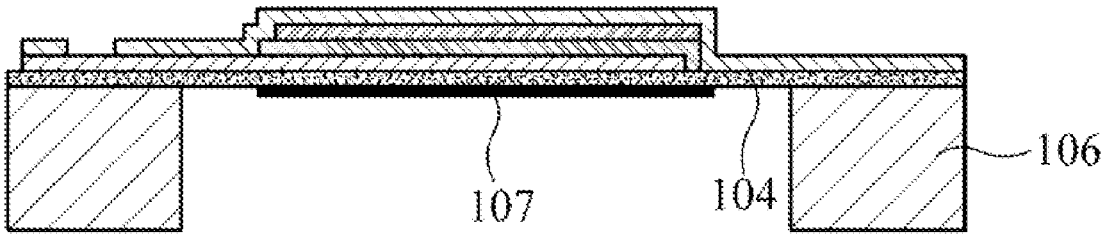

Subsequently, as illustrated in FIG. 12(D), a part of the substrate 106 is etched from the lower side to release the etch stop layer 107 and the diaphragm 104.

Figure 12E:
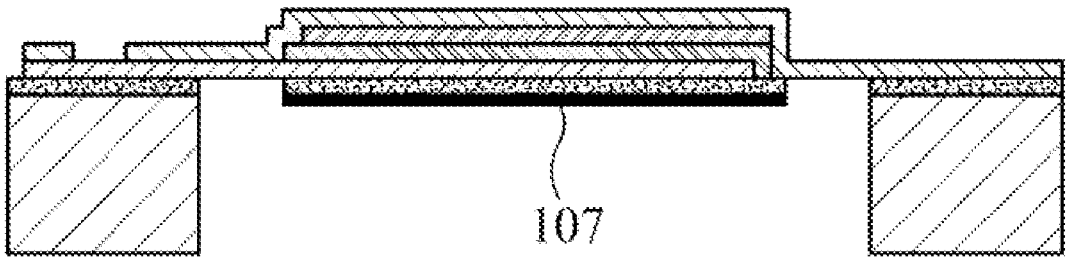

Subsequently, as illustrated in FIG. 12(E), a part of the diaphragm 104 is removed. For example, the diaphragm 104 excluding a part on which the etch stop layer 107 is formed can be removed by etching the diaphragm 104 from the lower side of the substrate 106. Here, the removed part of the diaphragm 104 may be a space in which the above-mentioned second region 202 will be formed.

Figure 12F:
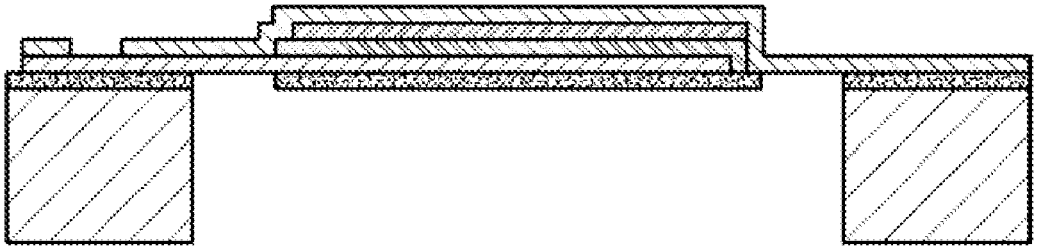

Finally, as illustrated in FIG. 12(F), the etch stop layer 107 is removed.

Figure 13:
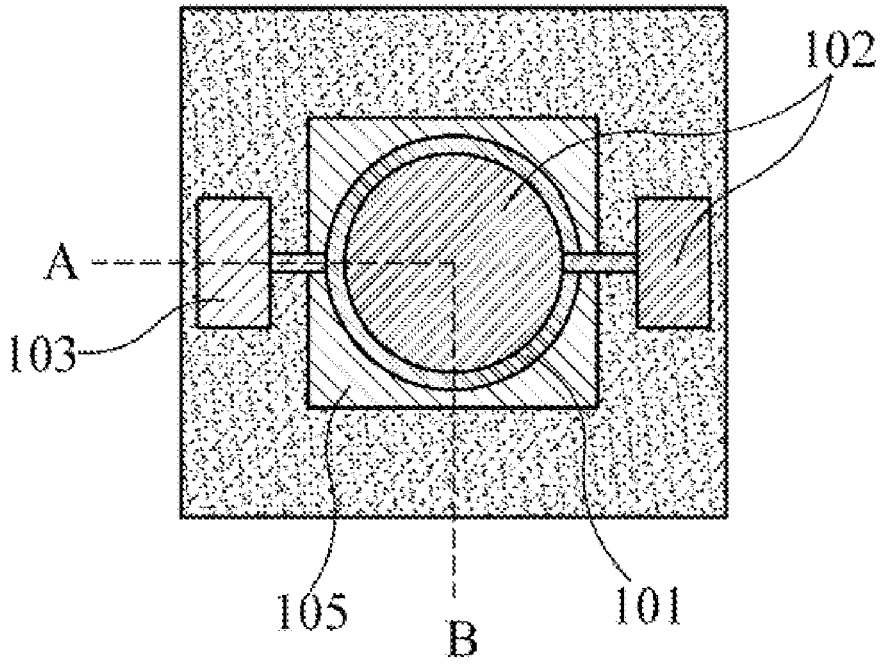
FIG. 13 is a plan view of a piezoelectric microspeaker according to another exemplary embodiment.
Figure 14:
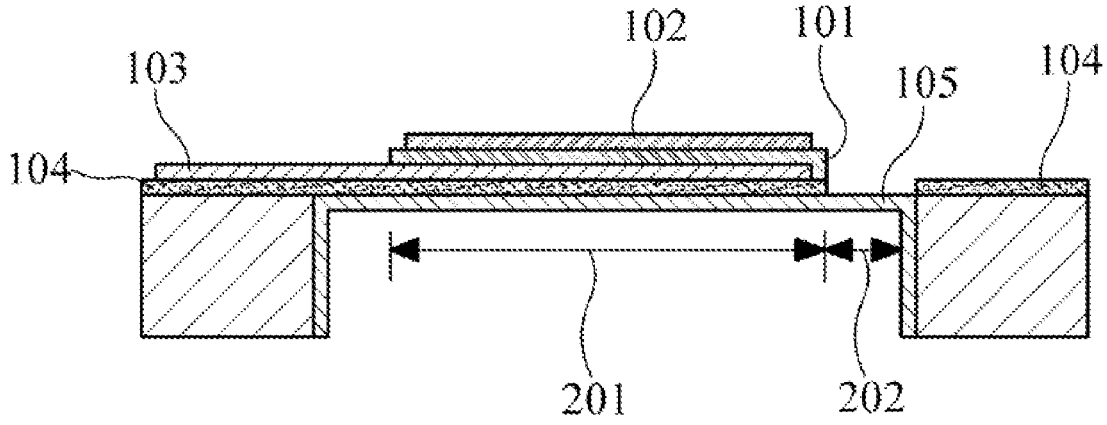
FIG. 14 is a cross-sectional view of the piezoelectric microspeaker according to the exemplary embodiment of FIG. 13.

FIG. 13 is a plan view of a piezoelectric microspeaker according to yet another embodiment, and FIG. 14 is a cross-sectional view taken along line A-B of FIG. 13.

Referring to FIGS. 13 and 14, the piezoelectric microspeaker according to this embodiment includes a piezoelectric plate 101, upper and lower electrodes 102 and 103, and a diaphragm 104. The diaphragm 104 includes a first region 201 and a second region 202 having different Young's moduli. The first region 201 may be formed of a material having a Young's modulus similar to that of the piezoelectric plate 101, and the second region 202 may be formed of a material having a Young's modulus lower than that of the first region 201. For example, the second region 202 may be understood as a region from which a part of the diaphragm 104 is removed and filled with a thin polymer layer 105.

FIGS. 15(A) to 15(E) are cross-sectional views illustrating a method of fabricating a piezoelectric microspeaker according to yet another embodiment.

The method of fabricating the piezoelectric microspeaker according to this embodiment will be described below with reference to FIGS. 15(A) to 15(F).

Figure 15A:
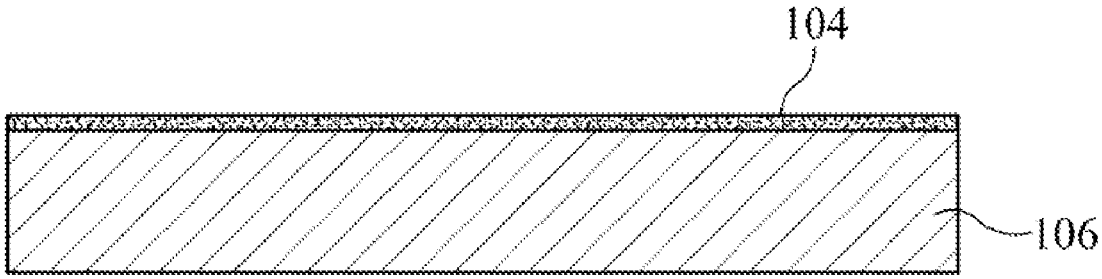
FIGS. 15(A) to 15(E) are cross-sectional views illustrating a method of fabricating the piezoelectric microspeaker according to the exemplary embodiment of FIG. 13.

First, as illustrated in FIG. 15(A), the diaphragm 104 is formed on a substrate 106. For example, the diaphragm 104 may be formed by depositing low-stress silicon nitride to a thickness of about 0.5 μm to 3 μm using a CVD process.

Figure 15B:
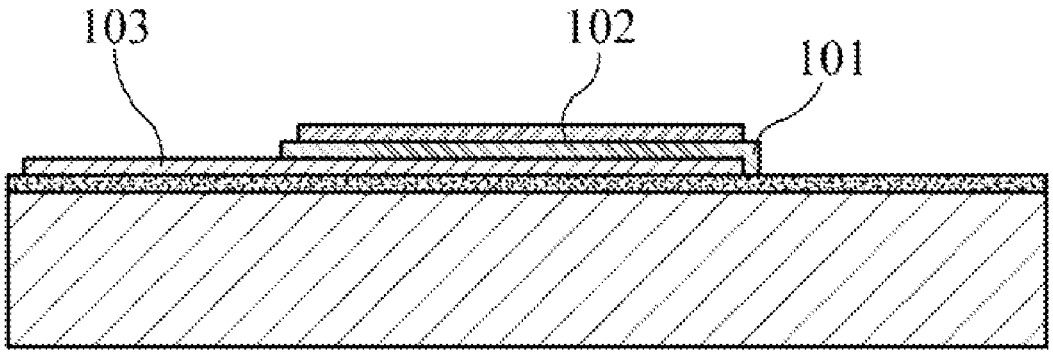

Subsequently, as illustrated in FIG. 15(B), the lower electrode 103 is formed by depositing and etching a thin metal layer on the diaphragm 104, the piezoelectric plate 101 is formed by depositing and etching a thin piezoelectric layer on the lower electrode 103, and then the upper electrode 102 is formed by again depositing and etching a thin metal layer on the piezoelectric plate 101.

Figure 15C:
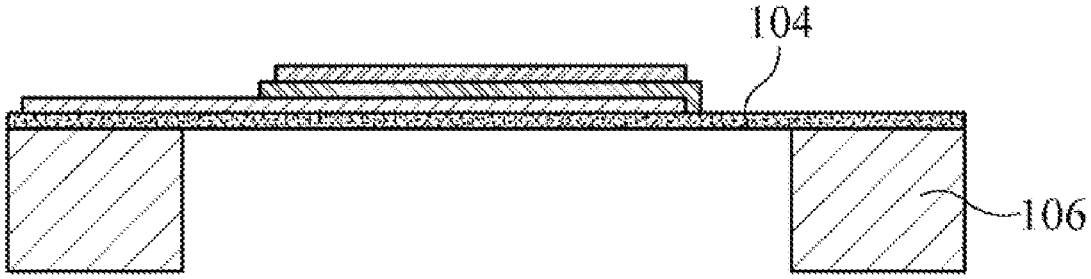

Subsequently, as illustrated in FIG. 15(C), a part of the substrate 106 is etched from the lower side to release the diaphragm 104.

Figure 15D:
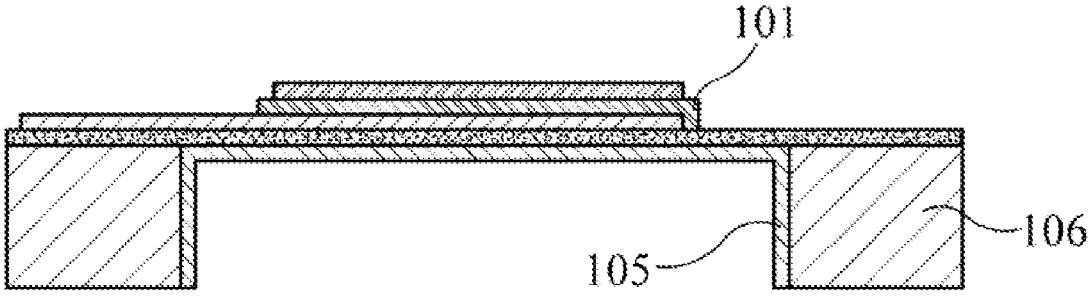

Subsequently, as illustrated in FIG. 15(D), the thin polymer layer 105 is formed through the etched part of the substrate 106. For example, the thin polymer layer 105 may be formed by depositing parylene having a Young's modulus lower than that of the piezoelectric plate 101 on the etched part of the substrate 106 and the released diaphragm 104.

Figure 15E:
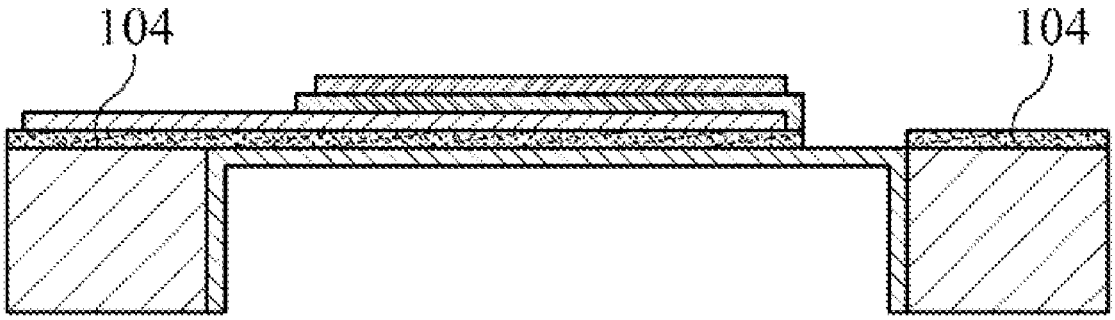

Finally, as illustrated in FIG. 15(E), a part of the diaphragm 104 is removed. For example, the piezoelectric plate 101 and the upper and lower electrodes 102 and 103 are covered with an etch mask, a non-covered part of the diaphragm 104 is selectively etched, and thus the part of the diaphragm 104 can be removed. Here, the removed part of the diaphragm 104 may be the whole or a part of the diaphragm 104 excluding a region directly under the piezoelectric plate 101, and may be the above-mentioned second region 202.

Figure 16:
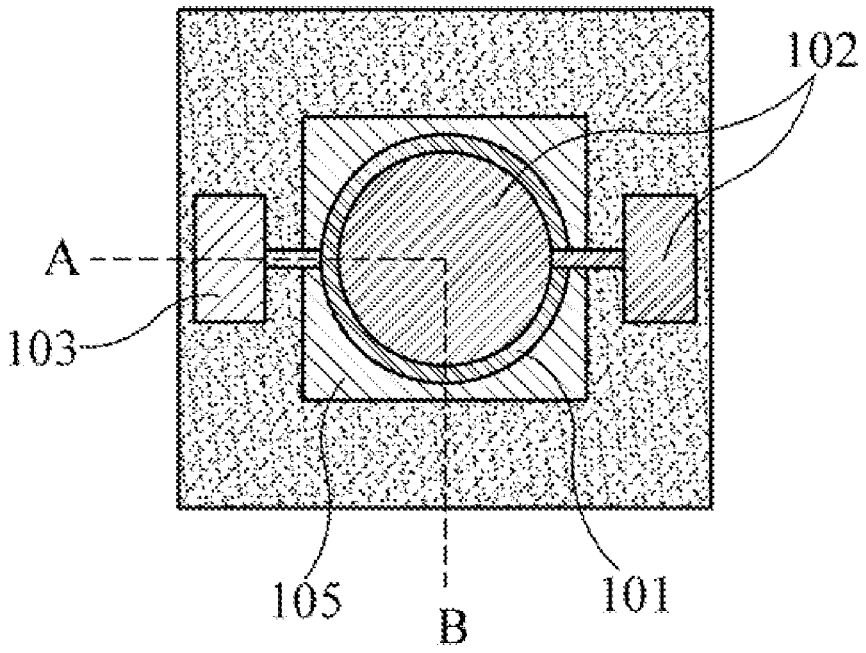
FIG. 16 is a plan view of a piezoelectric microspeaker according to another exemplary embodiment.
Figure 17:
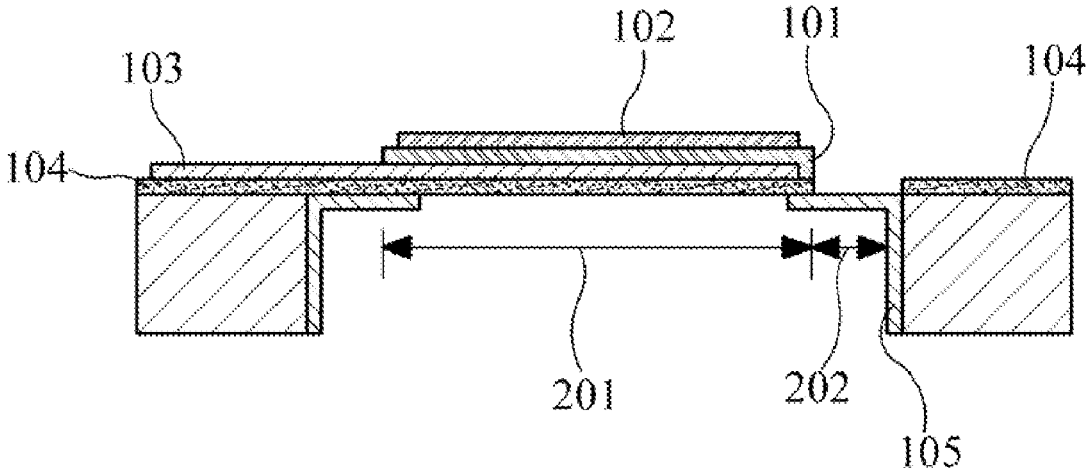
FIG. 17 is a cross-sectional view of the piezoelectric microspeaker according to the exemplary embodiment of FIG. 16.

FIG. 16 is a plan view of a piezoelectric microspeaker according to yet another embodiment, and FIG. 17 is a cross-sectional view taken along line A-B of FIG. 16.

Referring to FIGS. 16 and 17, the piezoelectric microspeaker according to this embodiment has the same structure as described with reference to FIGS. 13 and 14 except that a thin polymer layer 105 is selectively removed. In other words, in the piezoelectric microspeaker according to this embodiment, the thin polymer layer 105 is selectively etched to expose a part of a diaphragm 104.

FIGS. 18(A) to 18(E) are cross-sectional views illustrating a method of fabricating a piezoelectric microspeaker according to yet another embodiment.

The method of fabricating the piezoelectric microspeaker according to this embodiment will be described below with reference to FIGS. 18(A) through (F).

Figure 18A:
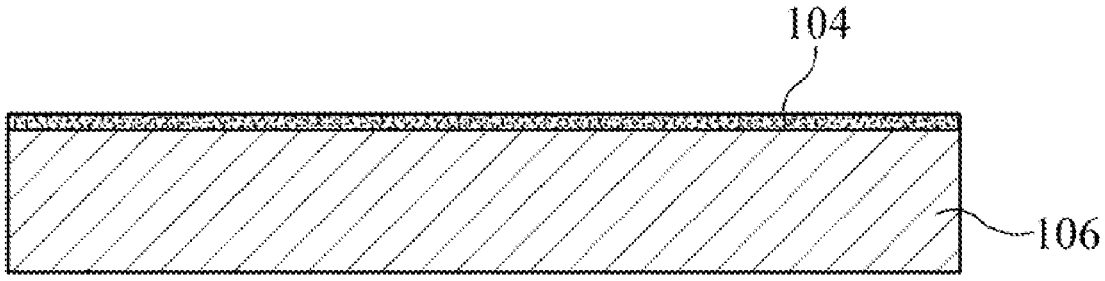
FIGS. 18(A) to 18(F) are cross-sectional views illustrating a method of fabricating the piezoelectric microspeaker according to the exemplary embodiment of FIG. 16.

First, as illustrated in FIG. 18(A), the diaphragm 104 is formed on a substrate 106. For example, the diaphragm 104 may be formed by depositing low-stress silicon nitride to a thickness of about 0.5 μm to 3 μm using a CVD process.

Figure 18B:
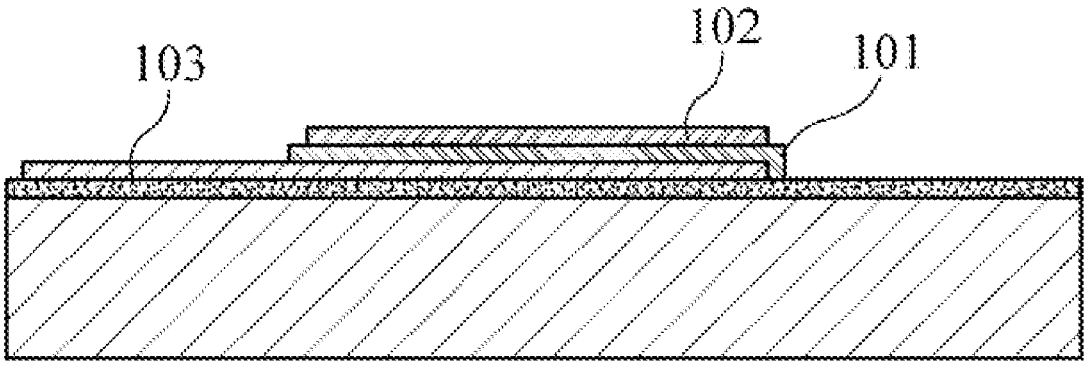

Subsequently, as illustrated in FIG. 18(B), a lower electrode 103 is formed by depositing and etching a thin metal layer on the diaphragm 104, a piezoelectric plate 101 is formed by depositing and etching a thin piezoelectric layer on the lower electrode 103, and then an upper electrode 102 is formed by again depositing and etching a thin metal layer on the piezoelectric plate 101.

Figure 18C:
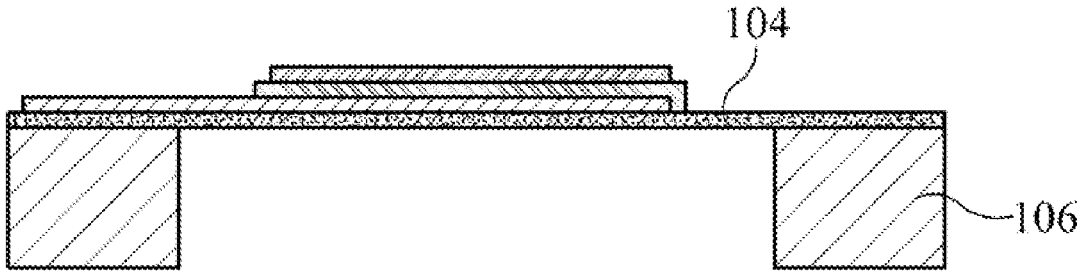

Subsequently, as illustrated in FIG. 18(C), a part of the substrate 106 is etched from the lower side to release the diaphragm 104.

Figure 18D:
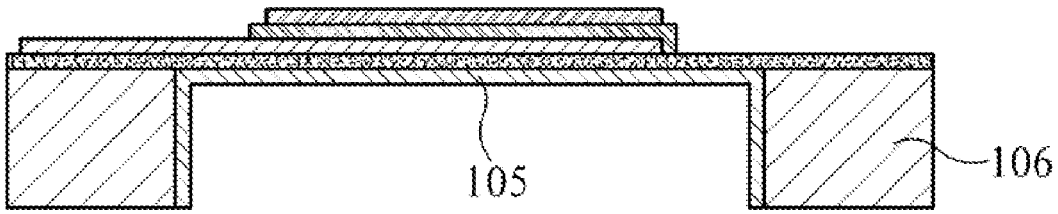

Subsequently, as illustrated in FIG. 18(D), the thin polymer layer 105 is formed through the etched part of the substrate 106. For example, the thin polymer layer 105 may be formed by depositing parylene having a Young's modulus lower than that of the piezoelectric plate 101 on the etched part of the substrate 106 and the released diaphragm 104.

Figure 18E:
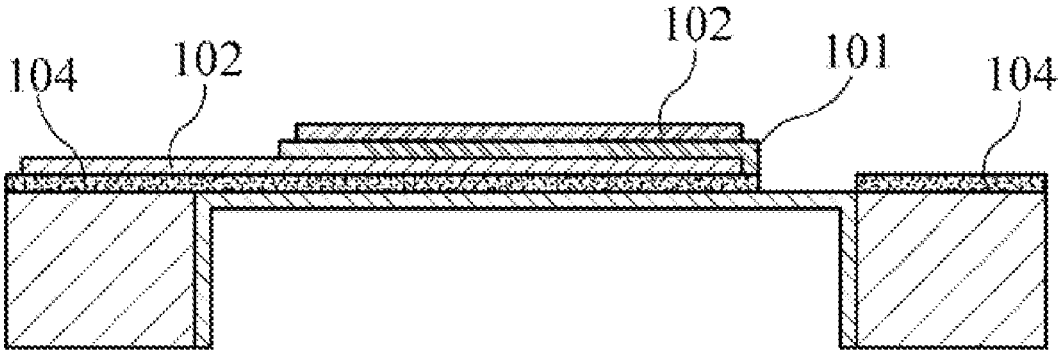

Subsequently, as illustrated in FIG. 18(E), a part of the diaphragm 104 is removed. For example, the piezoelectric plate 101 and the upper and lower electrodes 102 and 103 are covered with an etch mask, a non-covered part of the diaphragm 104 is selectively etched, and thus the part of the diaphragm 104 can be removed. Here, the removed part of the diaphragm 104 may be the whole or a part of the diaphragm 104 excluding a region directly under the piezoelectric plate 101, and may be the above-mentioned second region 202.

Figure 18F:
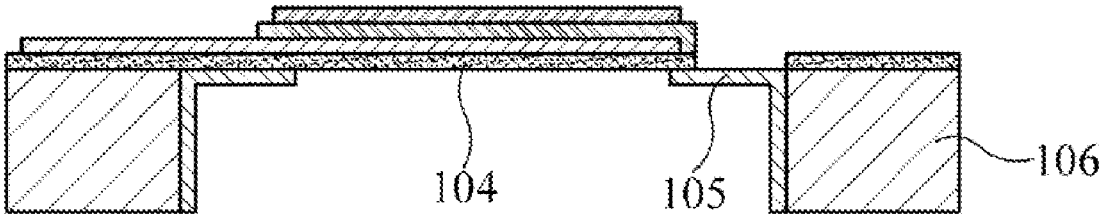

Finally, as illustrated in FIG. 18(F), the thin polymer layer 105 under the diaphragm 104 is removed to expose the diaphragm 104 to the outside.

Figure 19A:
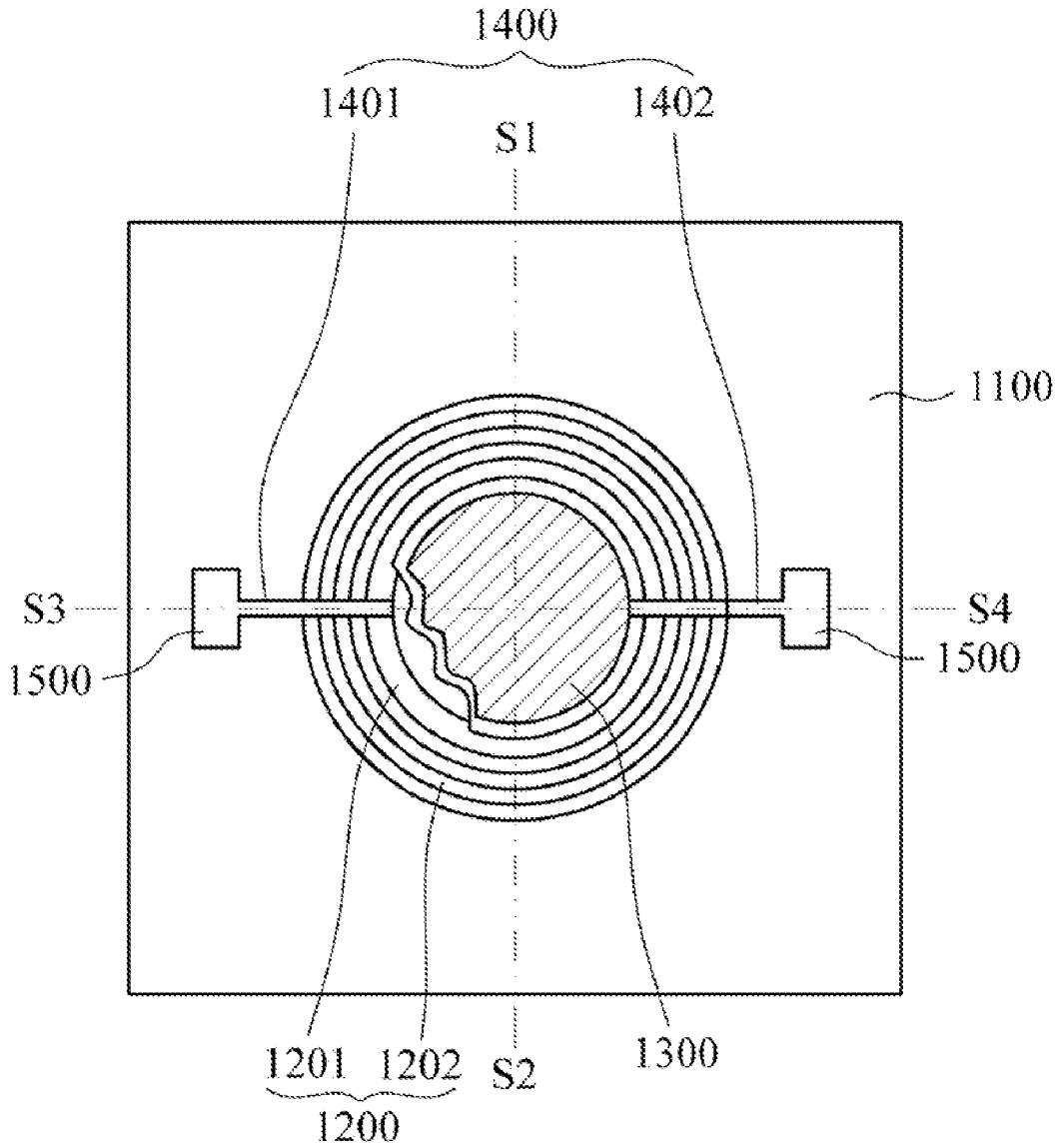
FIGS. 19(A) to 19(C) show a piezoelectric microspeaker according to another exemplary embodiment.
Figure 19B:
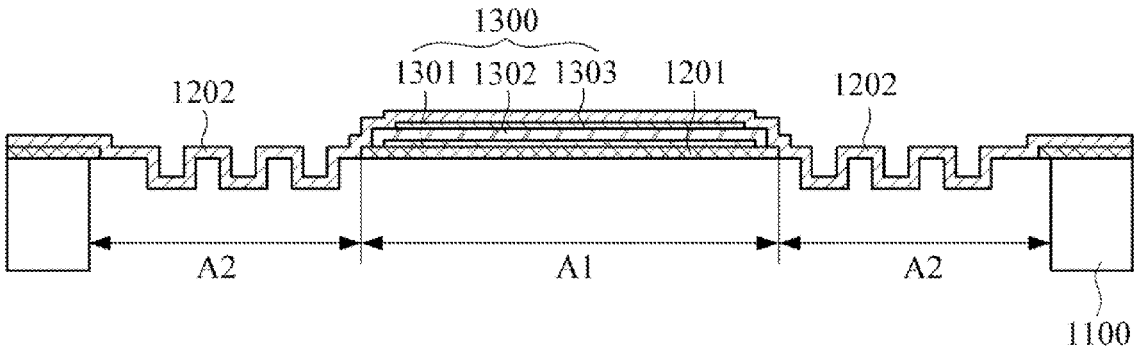
Figure 19C:
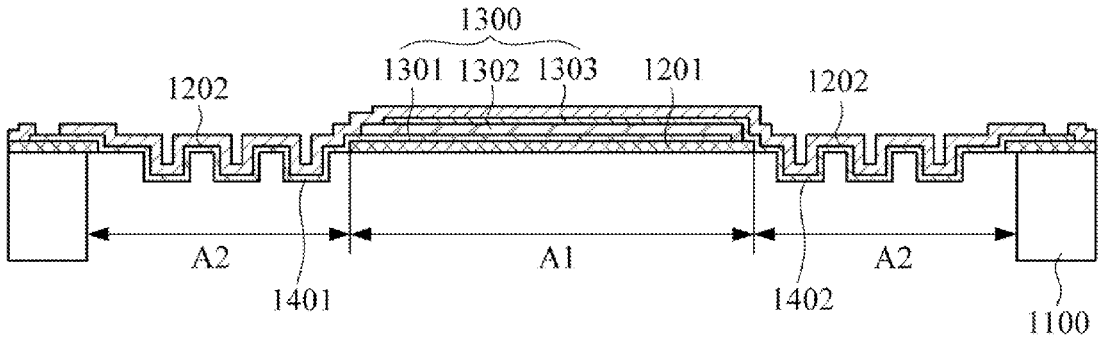

FIGS. 19(A) to 19(C) show a piezoelectric microspeaker according to yet another embodiment. FIG. 19(A) is a plan view of a piezoelectric microspeaker according to this embodiment, FIG. 19(B) is a cross-sectional view taken along line S1-S2 of FIG. 19(A), and FIG. 19(C) is a cross-sectional view taken along line S3-S4 of FIG. 19(C).

Referring to FIGS. 19(A) to 19(C), the piezoelectric microspeaker may include a substrate 1100, a diaphragm 1200, a piezoelectric driver 1300, a feeder cable unit 1400, and a pad 1500.

In the substrate 1100, a hole is formed which penetrates through the substrate 1100 in the thickness direction.

The diaphragm 1200 is formed on the substrate 1100 and covers the hole. When an external power supply is connected to the pad 1500, voltage is applied to the piezoelectric driver 1300 through the feeder cable unit 1400 connected with the pad 1500. The piezoelectric driver 1300 is deformed by the applied voltage, which causes the diaphragm 1200 to vibrate. When the diaphragm 1200 vibrates, sound can be output through the hole formed in the substrate 1100.

The diaphragm 1200 may include a first vibration layer 1201 and a second vibration layer 1202.

The first vibration layer 1201 is formed in a first region A1 corresponding to the center of the hole of the substrate 1100. For example, the first vibration layer 1201 may be formed directly under the piezoelectric driver 1300 and directly on the hole of the substrate 1100.

The second vibration layer 1202 is formed in a second region A2 corresponding to the edge of the hole of the substrate 1100. For example, the second vibration layer 1202 may be formed to surround the first vibration layer 1201.

The second vibration layer 1202 is formed of a material having a lower elastic modulus than the first vibration layer 1201. For example, the first vibration layer 1201 may be formed of silicon nitride having an elastic modulus, for example a Young's modulus, of about 50 Gpa to 500 Gpa, and the second vibration layer 1201 may be formed of a thin polymer layer having a Young's modulus of about 100 Mpa to 5 Gpa.

Also, the second vibration layer 1202 may be formed into a corrugated or ripple shape.

The piezoelectric driver 1300 may include a first electrode layer 1301, a piezoelectric layer 1302, and a second electrode layer 1303 sequentially stacked on the first vibration layer 1201. The piezoelectric layer 1302 may be formed of a thin AlN layer or a thin ZnO layer having a shape varying according to applied voltage. The first electrode layer 1301 is a lower electrode formed under the piezoelectric layer 1302, and the second electrode layer 1302 is an upper electrode formed on the piezoelectric layer 1302.

The feeder cable unit 1400 supplies the first electrode layer 1301 and the second electrode layer 1303 with voltage. For example, the feeder cable unit 1400 may include a first feeder cable 1401 connecting the pad 1500 connected with the external power supply and the first electrode layer 1301, and a second feeder cable 1402 connecting the pad 1500 connected with the external power supply and the second electrode layer 1303.

The respective feeder cables 1401 and 1402 may have a shape similar to that of the second vibration layer 1202. For example, each of the first feeder cable 1401 and the second feeder cable 1402 may be formed into the corrugated or ripple shape, like the second vibration layer 1202.

When power is applied to the piezoelectric driver 1300, the first vibration layer 1201 formed directly under the piezoelectric driver 1300 vibrates, and a second vibration layer 1202 around the first vibration layer 1201 supports the first vibration layer 1201. At this time, since the second vibration layer 1202 has a Young's modulus lower than that of the first vibration portion 1201, a mechanical resonant frequency can be lowered, and a sound pressure level of a low-frequency component can be thereby increased. Also, since the second vibration layer 1202 and the feeder cable unit 1400 are formed into a corrugated or ripple shape, it is possible to further lower the resonant frequency and improve durability.

FIGS. 20(A) to 20(E) are cross-sectional views illustrating a method of fabricating a piezoelectric microspeaker according to yet another exemplary embodiment of the present invention. These may be an example of a method of fabricating the piezoelectric microspeaker illustrated in FIGS. 19(A) to 19(C).

Figure 20A:
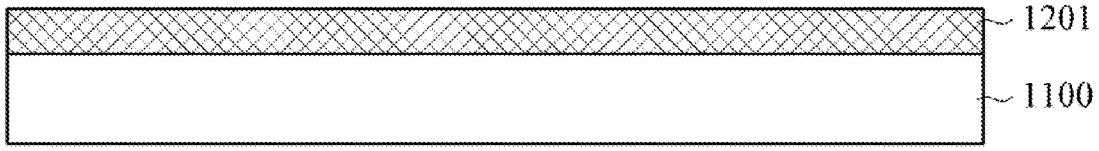
FIGS. 20(A) to 20(E) are cross-sectional views illustrating a method of fabricating the piezoelectric microspeaker according to the exemplary embodiment of the FIGS. 20(A) to 20(E).

Referring to FIG. 20(A), the first vibration layer 1201 is formed on one side of the substrate 1100. For example, the first vibration layer 1201 can be formed by depositing low-stress silicon nitride to a thickness of about 0.5 μm to 3 μm using a CVD process.

Figure 20B:
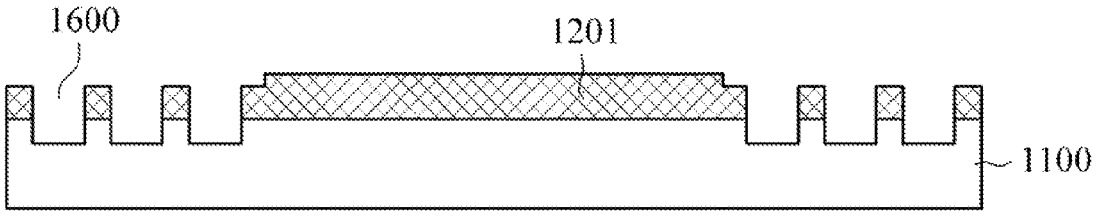

Referring to FIG. 20(B), a corrugated or ripple trench 1600 is formed by etching a part of the first vibration layer 1201. For example, a part of the first vibration layer 1201 corresponding to the center of the substrate 1100 is covered with a predetermined mask, and the other part of the first vibration layer 1201 is selectively etched to form the trench 1600.

Figure 20C:
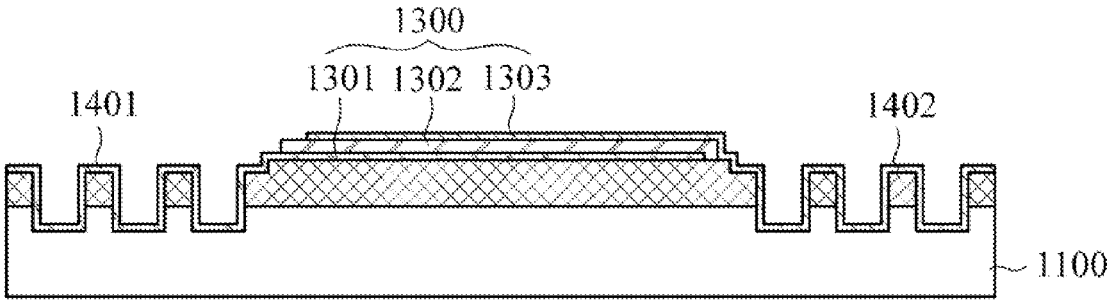

Referring to FIG. 20(C), the first electrode layer 1301, the piezoelectric layer 1302, and the second electrode layer 1303 are sequentially stacked on the first vibration layer 1201 to form the piezoelectric driver 1300. At this time, the first feeder cable 1401 having a corrugated or ripple shape corresponding to the trench 1600 and connecting an external power supply and the first electrode layer 1301 and the second feeder cable 1402 having a corrugated or ripple shape corresponding to the trench 1600 and connecting the external power supply and the second electrode layer 1303 may be formed together.

Figure 20D:
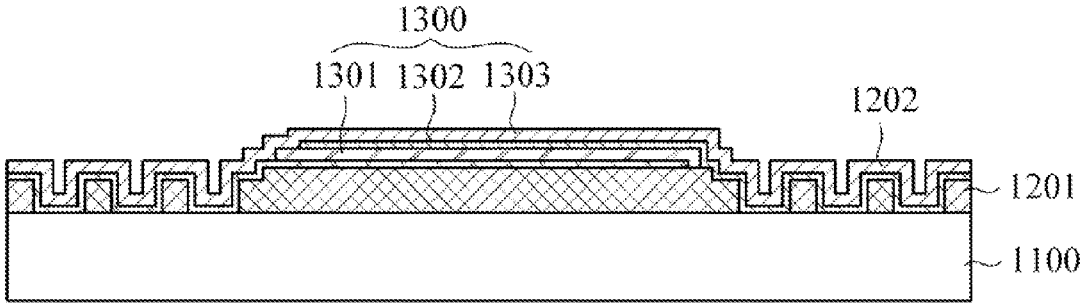

Referring to FIG. 20(D), the second vibration layer 1202 is formed on the first vibration layer 1201 on which the piezoelectric driver 1300 and the feeder cable unit 1400 are formed. For example, the second vibration layer 1202 can be formed according to a trench shape formed on the first vibration layer 1201 using a thin polymer layer having a Young's modulus lower than that of the first vibration layer 1201.

Figure 20E:
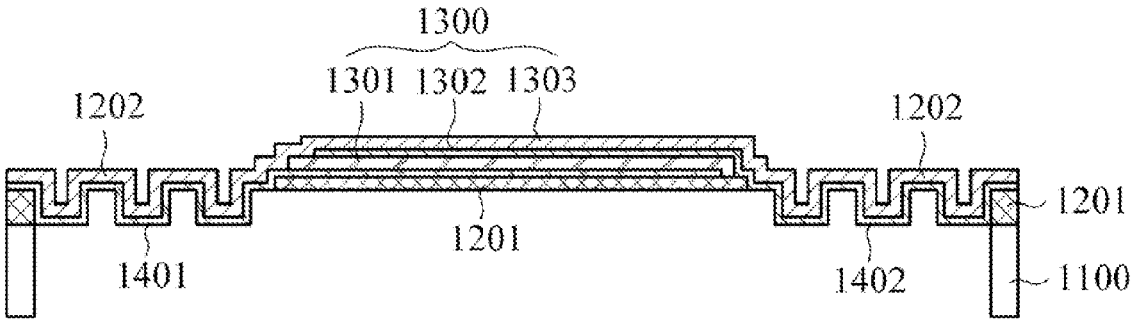

Referring to FIG. 20(E), a hole is formed in the substrate 1100 by etching the other side of the substrate 1100 until the first vibration layer 1201, the second vibration layer 1202, and the feeder cable unit 1400 under the second vibration layer 1202 are exposed. For example, the lower side of the substrate 1100 may be etched to expose the diaphragm 1200 including the first vibration layer 1201 and the second vibration layer 1202.

It should be understood that the embodiments described herein should be considered in a descriptive sense only and not for purposes of limitation. Descriptions of features or aspects within each embodiment should typically be considered as available for other similar features or aspects in other embodiments.

What is claimed is:

1. A piezoelectric micro-acoustic transducer comprising:

a substrate comprising a hole formed therethrough; and a diaphragm which is disposed on the substrate and covers the hole, the diaphragm comprising:

a first vibration layer which covers a first region of the hole, and a second vibration layer which covers a second region of the hole, wherein a Young's modulus of the second vibration layer is lower than a Young's modulus of the first vibration layer, and the second vibration layer has a corrugated shape.

2. The piezoelectric micro-acoustic transducer of claim 1, wherein the first region corresponds to a center of the hole and the second region corresponds to an edge of the hole.

3. The piezoelectric micro-acoustic transducer of claim 2, further comprising:

a piezoelectric driver disposed on the first vibration layer, the piezoelectric driver comprising a first electrode layer, a piezoelectric layer, and a second electrode layer stacked on the first vibration layer; and a feeder cable unit which is electrically connected to the first electrode layer and the second electrode layer, and having a corrugated shape corresponding to the corrugated shape of the second vibration layer.

4. The piezoelectric micro-acoustic transducer of claim 3, further comprising:

a first pad and a second pad, each connected to an external power supply, wherein the feeder cable unit connects the first pad to the first electrode layer through the second region and connects the second pad with the second electrode layer through the second region.

5. A piezoelectric microspeaker comprising:

a substrate comprising a hole formed therethrough;

a diaphragm comprising:

a first vibration layer disposed in a first region of the hole, and a second vibration layer disposed in the first portion over the first vibration layer and in a second region of the hole, such that the second vibration layer overlaps the hole and an area of the substrate surrounding the hole;

wherein a portion of the second vibration layer disposed in the second region has a corrugated shape; and wherein a Young's modulus of the second portion is lower than a Young's modulus of the first portion.

6. The piezoelectric microspeaker of claim 5, further comprising:

a piezoelectric driver disposed in the first region between the first vibration layer and the second vibration layer, the piezoelectric driver comprising:

a first electrode layer disposed on the first vibration layer, a piezoelectric layer disposed on the first electrode layer, and a second electrode layer disposed on the piezoelectric layer;

a first feeder cable unit electrically connected to the first electrode layer and extending through the second region; and a second feeder cable unit electrically connected to the second electrode layer and extending though the second region;

wherein the first and second feeder cable units each have corrugated shapes corresponding to the corrugated shape of the section vibration layer in the second region.

* * * * *